US009643399B2

(12) United States Patent
Scharkus et al.

(10) Patent No.: US 9,643,399 B2
(45) Date of Patent: May 9, 2017

(54) INK FEED DEVICE COMPRISING AN INK BLADE

(71) Applicant: KOENIG & BAUER AG, Würzburg (DE)

(72) Inventors: Volker Elmar Scharkus, Würzburg (DE); Volkmar Rolf Schwitzky, Würzburg (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 15/037,373

(22) PCT Filed: Sep. 16, 2014

(86) PCT No.: PCT/EP2014/069692

§ 371 (c)(1),
(2) Date: May 18, 2016

(87) PCT Pub. No.: WO2015/086183

PCT Pub. Date: Jun. 18, 2015

(65) Prior Publication Data

US 2016/0279926 A1 Sep. 29, 2016

(30) Foreign Application Priority Data

Dec. 12, 2013 (DE) ..... 10 2013 225 691

(51) Int. Cl.

| | |
|---|---|
| ***B41F 31/04*** | (2006.01) |
| ***B41F 31/05*** | (2006.01) |
| ***B41F 9/06*** | (2006.01) |
| ***B41F 9/10*** | (2006.01) |
| ***B41F 31/10*** | (2006.01) |

(52) U.S. Cl.
CPC ..... *B41F 31/04* (2013.01); *B41F 9/061* (2013.01); *B41F 9/109* (2013.01); *B41F 9/1036* (2013.01); *B41F 31/05* (2013.01); *B41F 31/10* (2013.01)

(58) Field of Classification Search
CPC ..... B41F 31/02; B41F 31/022; B41F 31/027; B41F 31/04; B41F 3/12
See application file for complete search history.

(56) References Cited

U.S. PATENT DOCUMENTS 3,610,203 A 10/1971 Muller
4,328,748 A 5/1982 Schramm
(Continued)

FOREIGN PATENT DOCUMENTS

DE 1225205 B 9/1966
DE 6901424 U 10/1969
(Continued)

OTHER PUBLICATIONS

International Search Report of PCT/2014/069692 dated Sep. 4, 2015.

*Primary Examiner* — David Banh
(74) *Attorney, Agent, or Firm* — Mattingly & Malur, PC

(57) ABSTRACT

An ink feed device includes an ink blade, a mounting device for the precise mounting of an ink blade and a system for feeding and dosing printing ink. The system includes an ink feed device and a mounting device. A method is provided for renewing a dosing edge of an ink blade, which edge is used to dose the ink. A method for operating an ink feed device, and including an ink blade, is also provided.

15 Claims, 15 Drawing Sheets

(56) References Cited

U.S. PATENT DOCUMENTS

| | | | | |
|---|---|---|---|---|
| 5,233,922 | A * | 8/1993 | Stirbis | B41F 31/04 101/363 |
| 6,062,139 | A * | 5/2000 | Tomita | B41F 31/04 101/351.2 |
| 6,178,887 | B1 * | 1/2001 | Hachiya | B41F 31/04 101/351.2 |
| 6,477,953 | B2 | 11/2002 | Fujimoto et al. | |
| 6,550,386 | B2 | 4/2003 | Fujimoto et al. | |
| 7,032,511 | B2 | 4/2006 | Pudark et al. | |
| 2004/0206259 | A1 * | 10/2004 | Pudark | B41F 31/05 101/350.1 |
| 2010/0243189 | A1 * | 9/2010 | Loippo | D21G 3/005 162/199 |
| 2011/0189378 | A1 * | 8/2011 | Moon | B05C 1/0817 427/9 |
| 2016/0070226 | A1 * | 3/2016 | Eerikainen | D21G 3/00 162/281 |

FOREIGN PATENT DOCUMENTS

| | | | |
|---|---|---|---|
| DE | 2004569 | A1 | 10/1970 |
| DE | 2709194 | A1 | 9/1978 |
| DE | 2951653 | A1 | 7/1981 |
| DE | 3613806 | A1 | 10/1987 |
| DE | 3834932 | A1 | 4/1990 |
| DE | 9109785 | U1 | 9/1992 |
| DE | 4240642 | A1 | 6/1994 |
| DE | 4410452 | A1 | 9/1995 |
| DE | 602005002142 | T1 | 3/2008 |
| EP | 0453872 | A1 | 10/1991 |
| EP | 1057629 | A2 | 12/2000 |
| WO | 02/16138 | A1 | 2/2002 |
| WO | 2006/038331 | A1 | 4/2006 |
| WO | 2011/077350 | A1 | 6/2011 |

* cited by examiner

INK FEED DEVICE COMPRISING AN INK BLADE

CROSS REFERENCE TO RELATED APPLICATIONS

This application is the U.S. National Phase, under 35 U.S.C. §371, of PCT/EP2014/069692, filed Sep. 16, 2014; published as WO2015/086183A2 and A3 on Jun. 18, 2015 and claiming priority to DE 10 2013 225 691.4 filed Dec. 12, 2013, the disclosures of which are expressly incorporated herein by reference.

FIELD OF THE INVENTION

The present invention relates to an ink feed device comprising an ink blade, a mounting device for the precisely defined mounting of an ink blade, a system for feeding and metering printing ink comprising an ink feed device and a mounting device, and a method for renewing a metering edge of an ink blade used for ink metering and a method for operating an ink feed device that comprises an ink blade. The ink feed device includes an integral or multi part frame and a blade holder that is arranged on the frame. An ink blade extends, in its mounted state, with a width that extends over at least a nominal width of an ink feed device. In its mounted state, the blade is held in a clamped gap of the blade holder and is releasably connected thereto. The blade extends in a longitudinal direction from an end on the holder side to an end that is distant from the holder. At its end distant from the holder, the blade comprises a metering edge which extends over at least the nominal width of the ink feed device. The metering edge may be continuous or discontinuous. End-face side walls, which laterally delimit an ink reservoir, when the ink feed device is in its operating state, are delimited on a lower region by the ink blade which is disposed in the blade holder. A plurality of adjusting devices are disposed side by side along the width of the ink blade to vary the blade, in sections, at least in the area of the metering edge with respect to a distance of the metering edge from a periphery of an inking unit roller which is to be inked by the ink feed device. The clamping gap has an excess dimension in its length that limits the movement of the ink blade. When the ink blade is mounted in its clamping gap, and is ready for operation, it does not abut with its end opposite to the metering edge against a rigid path limiter that is fixed to the blade holder in the clamping gap.

BACKGROUND OF THE INVENTION

DE 60 2005 002 142 T2 relates to an ink feed device embodied as an ink fountain, having a metering edge that is continuous over its width, wherein sections that are movable by means of adjusting means for adjusting the metering gap in zones are provided side by side below the ink blade. Such an inking unit is for use primarily in gravure printing. The ink blade in this case is preferably made of steel measuring 1 to 3 mm in thickness and having a ceramic coating. A further object is to enable a simple replacement of elements in the case of wear.

DE 42 40 642 A1 discloses an ink fountain having an ink blade holder, which holds ink blade segments side by side and can be removed as a complete unit from the ink fountain frame without disassembling the blade segments. To replace a worn metering edge, the entire blade support can be rotated, or the blade segments can be rotated in the blade holder, and therefore four edges can be used as metering edges.

DE 69 01 424 U1 relates to a device for adjusting a wiping doctor blade to be engaged on a gravure forme cylinder, wherein the shaping of the doctor blade can be adjusted by adjustment elements to match the curved surface, for example, of the cylinder to be wiped.

WO 2011/077350 A1 discloses a gravure printing press having a short inking unit comprising an ink fountain.

DE 36 13 806 A1 discloses an ink blade assembly, in which lamellar ink blades are attached by means of screws side by side on a receiving part, which is fastened by means of screws to an ink fountain bar. A cover connected via a support to the receiving part forms a clamping gap with the cover, in which the ink blade is clamped. The rearward end in this case does not extend up to the support located between receiving part and cover.

EP 0 453 872 A1 discloses an ink blade assembly with an ink blade, which is formed by a holder element, a bearing plate and a plurality of tongues fastened between the holder element and the bearing plate by means of first screws. The ink blade is fastened by means of second screws to an ink fountain. When the tongues become worn, the ink blade is disassembled, and once the first screws have been loosened, the tongues are arranged such that the front edges of the tongues are back in a starting position.

DE 91 09 785 U1 relates to a doctor blade device for applying a spread coating to the paper. The device comprises a spreading blade, which is clamped in a holding device between two jaws, and is thereby fastened with its rear edge free in the holder, i.e. in a non-travel limiting manner.

DE 38 34 932 A1 discloses a doctor blade holder and a doctor blade, wherein the doctor blade device comprises a supporting blade that supports the doctor blade, on both sides of a thin doctor blade that supports the doctor blade edge. To enable the largest possible part of the doctor blade to be used, when the doctor blade becomes worn, the lower supporting blade, which is releasably connected to the doctor blade in a form-fitting manner, can be adjusted in the doctor blade holder in the direction of the printing cylinder. In addition, the upper supporting doctor blade can be opened so that, once the one doctor blade edge has become worn, the doctor blade can be reinserted in a form-fitting connection, rotated 180°.

WO 02/16138 A1 discloses an ink feed device, in which individual ink blades are each fixed onto a blade carrier, in that they can be secured by a screw from the rear side against a stop which is fixed to the blade holder.

EP 1 057 629 A2 discloses an ink feed device in which an ink fountain attachment is arranged on a base support that carries a plurality of ink blades such that the ink fountain attachment can be removed. For this purpose, it has handles at its end faces.

DE 2 709 194 A1 discloses a device for inserting a doctor blade into a doctor blade holder. For this purpose, a holder is opened, the doctor blade is placed between a lower holder part and an upper holder part with the metering edge against a doctor blade stop, and finally the holder is closed. The opened doctor blade holder to be loaded is then moved up against the holder such that it rests in the region of a bearing stop. Finally, with doctor blade and doctor blade holder in this relative position, the latter is closed.

DE 38 34 932 A1 discloses a doctor blade holder with a doctor blade, wherein the doctor blade is embodied as thin, and is clamped between an upper and a lower supporting doctor blade. When the front end of the doctor blade becomes worn away as a result of friction, it can be readjusted to reproduce a sufficient forward projection beyond the upper and lower supporting doctor blade. When the clamping device is open, the doctor blade can also be rotated, so that the front edge is at the rear and the rear edge is at the front. When a doctor blade is used which is produced from a thicker material by grinding the opposing edge regions, when the doctor blade is readjusted these opposing edge regions must be remachined by grinding.

SUMMARY OF THE INVENTION

In a device for metering ink onto the ink fountain roller of an inking unit, a metering strip is formed by a plurality of base plates arranged side by side and movable in the direction of the cylinder, on each of which a plurality of slide elements that can be moved on the respective base plate in the direction of the cylinder, are disposed. The forward and backward movement of the slide elements is limited by a stop that engages in a recess.

The object of the present invention is to devise an ink feed device that comprises an ink blade, a mounting device for the precise mounting of an ink blade, a system for feeding and metering printing ink having an ink feed device and a mounting device, and a method for renewing a metering edge of an ink blade which is used for metering ink, and a method for operating an ink feed device that comprises an ink blade.

The object is attained according to the invention by the provision, on the frame, of a stop device that limits movement of the blade holder in a direction toward the metering edge or toward the inking unit roller. A stop is fixed to the frame and limits the movement of the blade holder in the direction toward the metering edge or toward the inking unit roller. The stop cooperates with a stop surface that is fixed to the blade holder and against which the blade holder can be moved or which can be acted on by a force so as to occupy its operating position by activating a fastening mechanism that is part of a fastening device.

It is a particular advantage that the proposed solution provides for the quick and/or simple and/or cost-effective handling of a zonally adjustable ink feed device which comprises an integral or multipart ink blade.

The routine use of abrasive ink, in particular, for example in gravure printing, results in wear of the metering edge, despite the use of hard metal cutting edges on the ink blades or ink blade sections, as have heretofore been used, and this necessitates constant readjustment or replacement of the ink blade. In the case of replacement, it has heretofore been necessary to very precisely adjust the individual zones, i.e. set them to zero, which is extremely costly and frequently cannot be carried out by the consumer.

Since it is preferable to use an integral ink blade which is separate from the adjusting means with which it interacts, the adjustment elements can be set in advance such that the zero position of the adjusting means or the drives thereof does not need to be reset every time the blade is changed. This also prevents wear on the actual adjusting means, which may be more costly.

Since the ink blade can be separated from the adjusting means, the blade can be used on a plurality of its edges as a metering edge.

A clamping gap that receives the ink blade is preferably embodied as having excess length, so that when the ink blade is mounted and ready for operation, it does not abut with its end, i.e. with its end that is opposite metering edge 27, in the clamping gap. This enables the blade to be precisely and easily readjusted at any time in the longitudinal direction in the blade holder, which can be installed e.g. in its correct position—even after it has been shortened by resharpening.

To enable an easily reproducible positioning of the ink blade, the blade is disposed in the ink fountain on a blade holder, which can be removed from the ink fountain and which can also be inserted in a precise fit into a mounting device. A new, rotated or resharpened ink blade can thereby be mounted in the blade holder precisely and without error in the same way that it will be used in the ink fountain. Using a single mounting device, a plurality or all of the ink blades for all ink fountains of the same type and configuration in the printing press, and optionally also for other presses having the same type of ink fountain, can be adjusted.

In a further enhancement, the ink blade projects beyond the region outside of the adjusting means, i.e. the nominal width, and rests at both sides on non-adjustable guide rails, thereby producing a lateral seal in a simple manner.

In an advantageous enhancement, the overall adjustment path of the adjusting means is significantly larger than is absolutely necessary for the operational opening and closing of the gap. With a corresponding setting to zero during insertion of a turned, resharpened or new ink blade, the adjustment path that is not used for adjustment during printing operation can be used for readjusting the zero position, which may be necessary, e.g. due to wearing of the ink blade edge. The zero positions can thereby be readjusted directly using the servo motors of the adjusting means. Only after the entire adjustment range has been utilized is the ink blade in question rotated or turned, or replaced with a new blade or a newly sharpened blade. The original zero position of the adjusting means is then reset again for this purpose.

Because the ink blade can be removed easily along with the blade holder and reinserted in its precise position, the ink blade can be cleaned outside of the ink fountain, e.g. in a special washing cabinet.

The preferred integral and/or continuous embodiment of the ink blade and/or the metering edge thereof completely rules out any passage through slot-type openings, as can occur in a multipart or slotted embodiment of the ink blade. In contrast to the discontinuous, stepped profile of separate blade sections, the continuous metering edge produces the shape of a zonally adjusted ink profile with softer transitions.

In a particularly advantageous ink feed device for an inking unit of a printing press, the ink feed device comprises an integral or multipart frame, a blade holder which is or can be disposed on the frame, an integral or multipart ink blade which, in the mounted state, extends widthwise across at least the entire nominal width of the ink feed device, and which, in the mounted state, is held within a clamping gap of the blade holder and is detachably connected thereto, and which extends in a longitudinal direction from a holder-side end up to an end remote from the holder, wherein, at its end that is distant from the holder, it comprises a metering edge which is continuous or is discontinuous in sections, and which extends as a whole over at least the nominal width. This particularly advantageous ink feed device further comprises end-surface side walls, which laterally delimit or can delimit an ink reservoir space, which is delimited in a lower region by the ink blade disposed in or on the blade holder when the ink feed device is in the operational state, a plurality of adjusting means, arranged side by side as viewed widthwise along the ink blade and configured for varying or being capable of varying the integral or multipart ink blade (26) in sections, at least in the region of the metering edge, in terms of its distance from the periphery of an inking unit roller to be inked up by the ink feed device, wherein the clamping gap is embodied as having excess dimensions in terms of its length that limits the movement of the ink blade, so that when the ink blade is mounted and ready for operation, its end, i.e. its end opposite the metering edge, does not abut in the clamping gap against a rigid path limiter that is fixed to the blade holder, and wherein a stop device that limits movement of the blade holder toward the metering edge and/or toward the inking unit roller and has a stop that is fixed to the frame—and particularly limits movement of the blade holder toward the metering edge and/or toward the inking unit roller, is provided on the frame, and cooperates with a stop surface that is fixed to the blade holder and toward which the blade holder can be moved in order to assume its operating position by actuating a fastening mechanism that is part of a fastening device, and/or can be acted on by force. In a particularly advantageous embodiment, a movably mounted clamping element for fastening and releasing the blade holder is provided on the frame of the ink feed device. The blade holder can thereby be moved in the direction of the metering edge, for example, without changing position in any other direction. The movement of the clamping element causes a second clamping element and/or the inserted blade holder to move, for example, with at least one movement component, preferably precisely or substantially (i.e. with a maximum of ±10° deviation in direction from the longitudinal direction) in the longitudinal direction of the metering blade in the direction of the metering edge.

Alone or, in an advantageous enhancement, in combination with an aforementioned ink feed device, a particularly advantageous mounting device for the precise mounting of an ink blade comprising a metering edge on a blade holder of an ink feed device for an inking unit of a printing press is provided, said mounting device having a holding section, on or in which the blade holder or at least a part of a multipart blade holder can be inserted in a defined position with a stop surface against a holder stop that limits movement in the direction of the ink blade to be mounted and is fixed to the frame, and having a stop section which is rigidly connected via an integral or multipart frame to the holding section, and on or in which the integral or multipart ink blade to be mounted can be placed with its metering edge against a blade stop, wherein the configuration and the relative position between the holder stop and the blade stop are defined in the manner of a mounting template, so that the blade holder or part of the multipart blade holder inserted into the holding device and the blade placed on the blade stop are in a position relative to one another that is desirable for mounting and is defined by the mounting device, at least as viewed in a longitudinal direction of the ink blade that extends perpendicular to the metering edge, even in the unconnected state.

In a particularly preferred system for feeding and metering printing ink into an inking unit of a printing press, the system comprises an ink feed device having a frame, on which a blade holder is detachably arranged, which, in the mounted state, holds an integral or multipart ink blade, the forward end of which projects beyond the blade holder and forms a continuous or discontinuous metering edge, wherein the blade holder, with the help of a stop device, can be disposed releasably on the frame in a defined orientation and position. This preferred system further has a mounting device with a frame, on which the blade holder for mounting the ink blade is releasably disposed, wherein the blade holder can be releasably disposed on the frame in a defined orientation and position relative to a blade stop on the side of the metering edge with the help of a stop device, wherein the configuration and the relative position between the stop device for the mounting device and the blade stop are defined in the manner of a mounting template such that the blade holder and the ink blade are in a defined and reproducible position relative to one another in their as yet unconnected state, in which they can then be connected to one another, and wherein the relative positions occupied by blade holder and ink blade in the connected state are dimensioned such that the ink blade is in a reproducible position predetermined by the mounting device in the state in which it is inserted into the ink feed device and rests against the stop device.

In a particularly advantageous method, a metering edge for metering ink in an integral or multipart ink blade in an ink feed device of a printing press, which metering edge extends widthwise across at least a nominal width of the ink feed device, is renewed, wherein first a blade holder that supports the ink blade is removed, along with the ink blade, from the ink feed device, the metering edge for metering ink is renewed in that the ink blade, which is still located on the blade holder or has already been separated therefrom, is resharpened at the end that comprises the metering edge, thereby forming a metering edge that has been renewed by machining in the region of this end, the relative position between the blade holder and the ink blade—particularly resharpened in this manner—is readjusted with respect to the position of the new metering edge while the connection is released and before the blade holder is inserted, and the connection is established with the relative position adjusted, and finally the blade holder along with the ink blade is reinserted in a defined position and orientation into the ink feed device and secured therein.

In a particularly advantageous method for operating an ink feed device of an inking unit of a printing press—in particular embodied as a gravure printing press—having an integral or multipart ink blade, which can be varied in sections using allocated adjusting means to form an ink gap in the gap dimension, i.e. in the distance created from the surface of an assigned inking unit roller when the blade is in the operating position, in that first a setting to zero—e.g. manual—of the ink gap in the zones assigned to the adjusting means to a gap dimension that represents the closed position is carried out, wherein the gap dimension is set to zero in that in this zero position of the blade section, the adjusting means in question are located in a zero position, which is spaced at both ends of the adjustment region for the adjusting means—particularly significantly, i.e. for example by at least 20% of the adjustment region for the adjusting means—, after at least one production phase the gap dimension in the blade sections is checked with the adjusting means located in the zero position, if one or more of the blade sections deviates from the gap dimension that is desired for the zero position, the adjusting means assigned to the blade section in question is activated for the purpose of readjustment, in order to reinstate the desired gap dimension that represents the closed position, and finally, the position occupied by the adjusting means following readjustment is established as the new zero position of the adjusting means. In a preferred enhancement, after one or more readjustments of one or more ink blade sections, the metering edge of the integral or multipart ink blade that acts to meter ink can be renewed according to an above-described, particularly advantageous method of renewal.

The stated, particularly advantageous variants and/or enhancements of the ink feed device and/or features that enhance the mounting device or the method for renewing the metering edge and/or the method for operating the ink feed device, as specified in the dependent claims and/or hereinafter described in reference to the embodiment examples, may be added individually or in multiples to form advantageous enhancements.

BRIEF DESCRIPTION OF THE DRAWINGS

Embodiment examples of the invention are represented in the set of drawings and will be described in greater detail in the following.

The drawings show.

DESCRIPTION OF PREFERRED EMBODIMENTS

Figure 1:
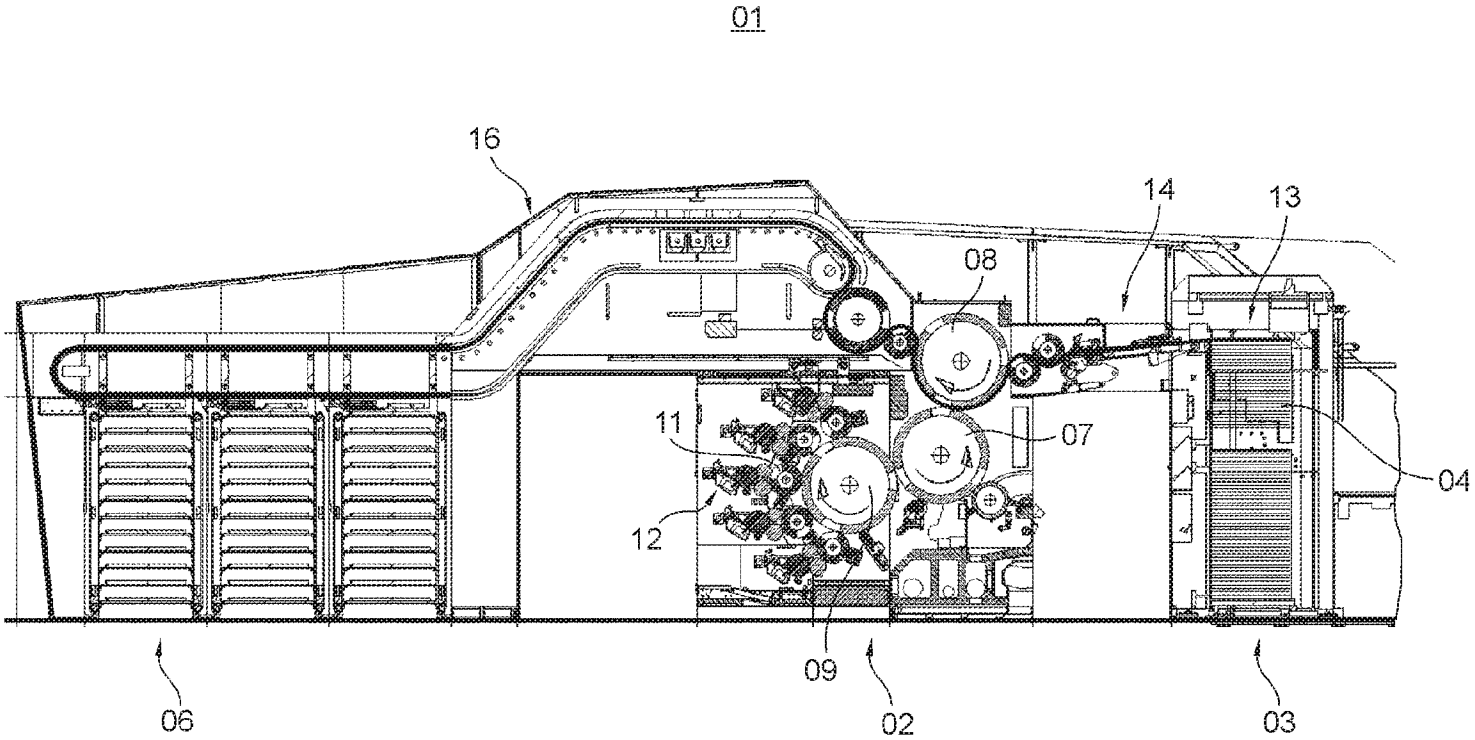
FIG. 1 an embodiment example of a printing press.
Figure 2:
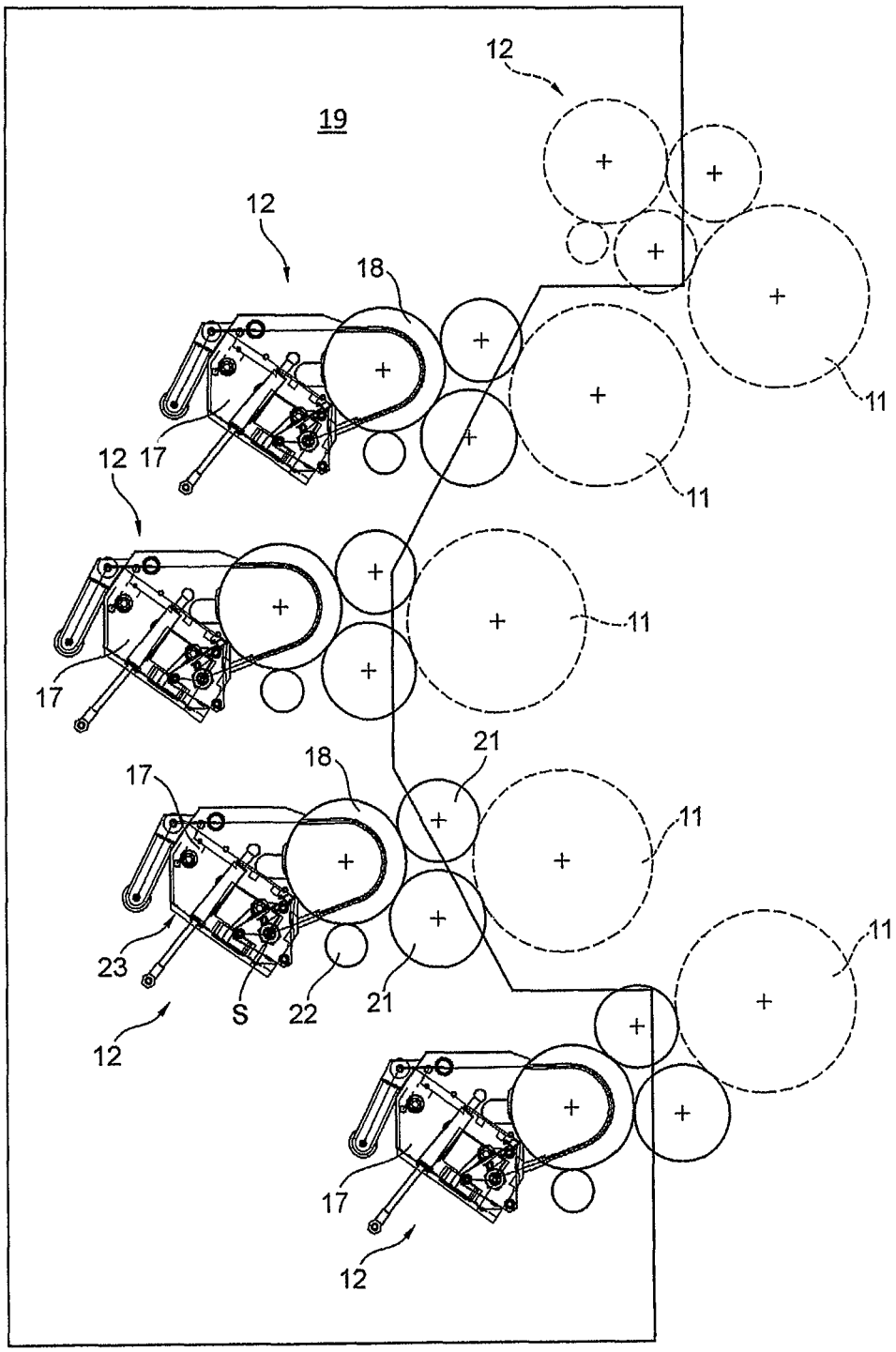
FIG. 2 an enlarged representation of inking units mounted in an inking unit frame.
Figure 3A:
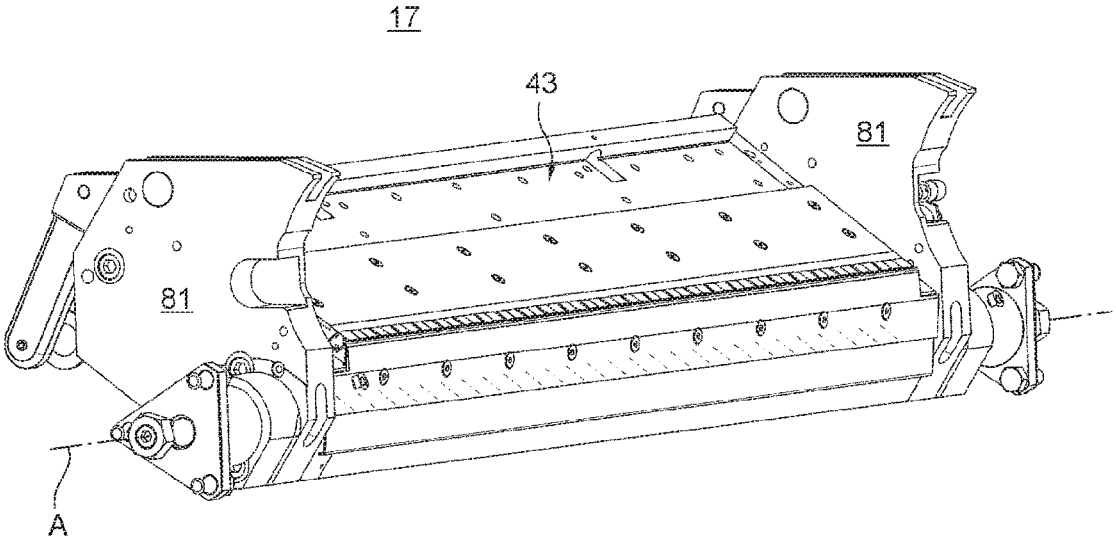
FIG. 3*a*) front-side and *b*) rear-side oblique views of an ink fountain frame without a blade holder.
Figure 3B:
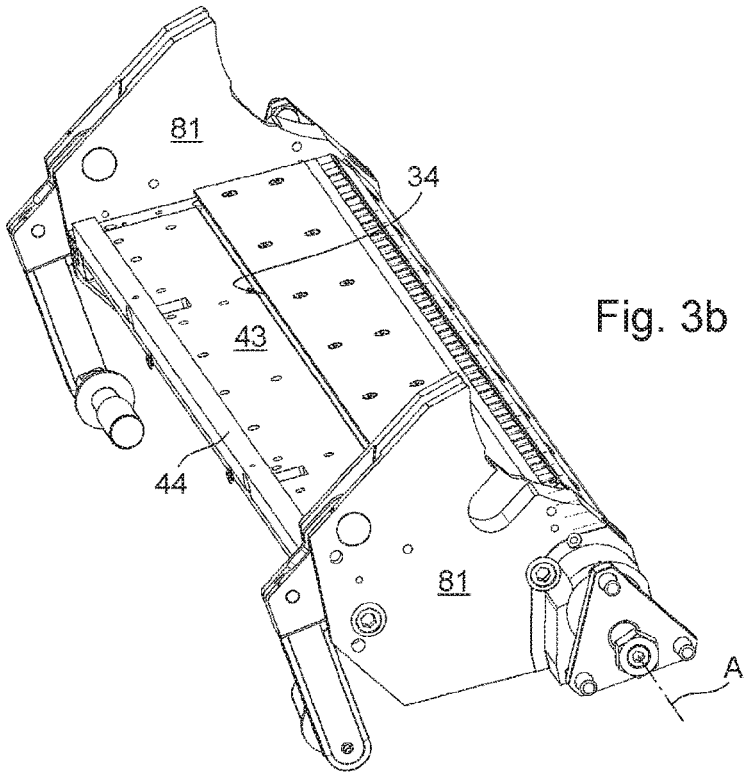
Figure 4A:
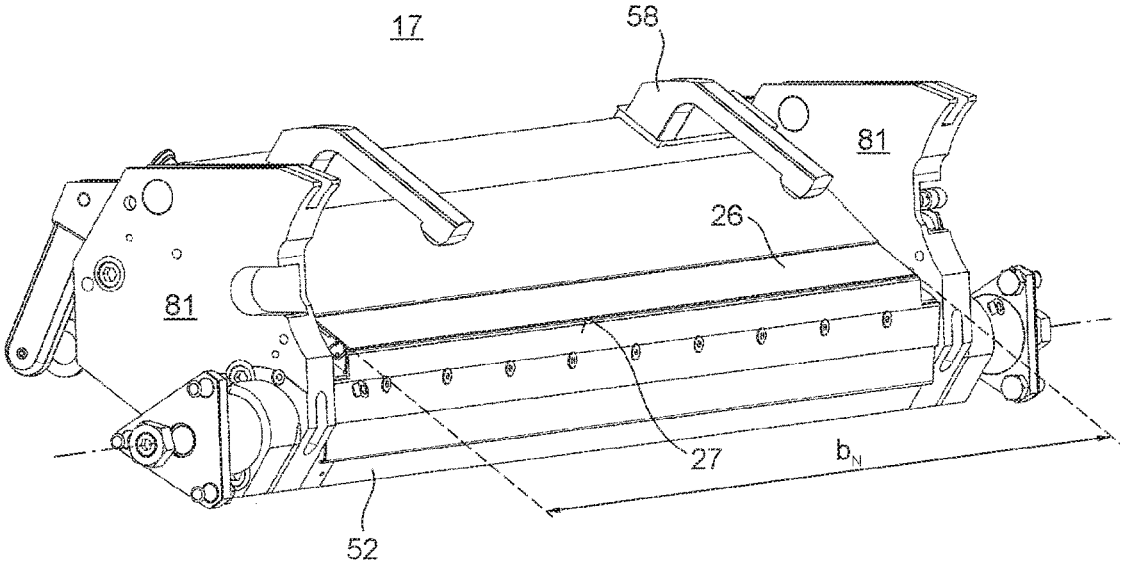
FIG. 4*a*) front-side and *b*) rear-side oblique views of the ink fountain frame with the blade holder inserted.
Figure 4B:
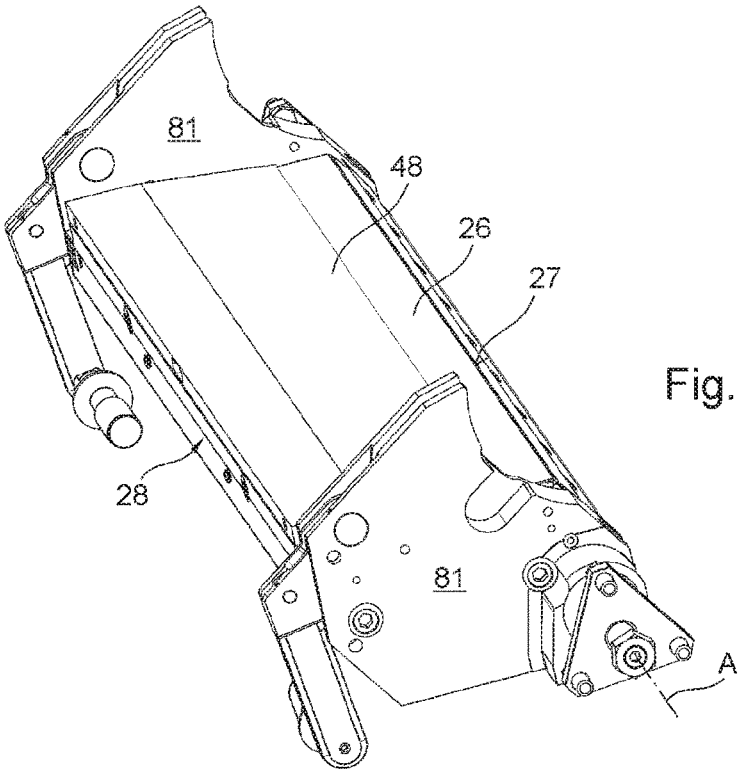

A printing press 01, e.g. embodied as a web-fed printing press or preferably as a sheet-fed printing press, comprises a printing assembly 02, e.g. a printing unit 02, which is supplied on the input side with a printing material 04, preferably in a sheet or web form, by an infeed device 03, and by means of which printing material 04 is supplied and by means of which printing material 04 is printed on one side or on both sides with a single color or multiple colors, and a product delivery unit 06, where printed products or intermediate products are delivered in stacks or continuously (see, e.g. FIG. 1). In a preferred embodiment illustrated in the figures, printing press 01 is embodied as printing press 01 for security printing, for example for printing web-type printing material 04, e.g. a printing material web, but preferably for printing web-type printing material 04, e.g. printing material sheets 04. In this case, infeed device 03 is embodied e.g. as sheet feeder 03, in which a stack of the printing material sheets 04 to be fed in and printed is and/or can be arranged. Product delivery unit 06 can be embodied as a sheet delivery unit 06 which forms one or more stacks.

In principle, printing assembly 02 of the printing press, which is preferably embodied as security printing press 01, can be embodied as printing assembly 02, which is based on any printing method. It comprises at least two printing unit cylinders 07; 08. At least one of the printing unit cylinders 07 is embodied as printing forme cylinder 07, which carries on its circumference a printing forme of the print image to be printed, and which can be inked up directly or indirectly, i.e. directly or via a train of one or more additional cylinders 09; 11, by at least one inking unit 12 with printing ink of at least one color. The printing forme in this case can be embodied as a planographic printing forme, a letterpress printing forme or preferably a gravure printing forme, and can be embodied directly as part of the cylinder shell, or preferably as a printing plate that can be detachably mounted on printing forme cylinder 07. In the embodiment of the printing assembly 02 configured for gravure printing, printing forme cylinder 07 cooperates with a wiping cylinder, not labeled, by which the surplus ink is removed from the printing forme, leaving ink only in the depressions in the engraving.

Printing material 04 is most preferably embodied as paper, which is formed with textile, linen or hemp fibers, and/or preferably comprises positive and/or negative water marks in the as yet unprinted state.

Printing material sheets 04, which are provided in the preferred case of a sheet-fed printing press, are held in reserve in the form of a stack in feeding device 03, embodied as a sheet infeed unit 03, from which they are removed individually by a gripper device 13 (not further detailed) which comprises suction cups, for example, and are conveyed separately via a conveyor path 14, e.g. a conveyor system embodied as a belt system and having one or more belt sections and/or at least one table close to the intake region of printing assembly 02, for entry into printing assembly 02. At the intake to printing assembly 02, printing material sheet 04 is transferred to a conveyor path assigned to printing assembly 02, e.g. to a conveyor system assigned to printing assembly 02, in which printing material sheet 04, or sheet 04, passes one or optionally more print positions along its transport path before being transferred from the conveyor path assigned to printing assembly 02 to a third conveyor path 16, e.g. comprising a conveyor system embodied as a belt system, and being transported by this path up to product delivery unit 06, e.g. a product delivery unit 06 comprising one or more sheet delivery units for stack formation. In the preferred case of a sheet-fed printing press, the conveyor path assigned to printing assembly 02 is embodied, e.g. as a gripper system, in which printing material sheet 04 is conveyed over one or more drums and/or cylinders, e.g. transport drums and/or transport cylinders, in succession in the transport direction, along the transport path through printing assembly 02. In the present case, a printing forme cylinder 08 embodied as impression cylinder 08 also acts as a transport cylinder and has gripper devices (not shown here) in its circumferential region.

In the preferred and illustrated embodiment, printing assembly 02 is embodied as printing unit 02 for at least simplex printing according to an Orlof method and/or for at least simplex printing according to a gravure printing method, in particular for steel engraving printing (see, e.g. FIG. 1). In addition to printing unit cylinder 07 embodied as printing forme cylinder 07, printing assembly 02 comprises upstream—which relates to the effective direction of transport of the printing ink—an ink collecting or Orlof cylinder 09, which inks up printing forme cylinder 07, and impression cylinder 08—e.g. in the case of the preferred sheet printing, comprising the gripper devices—, which together with printing forme cylinder 07 forms the print position. In principle, impression cylinder 08 could also be embodied as a printing unit cylinder 08 of a printing unit, in particular an offset printing unit, for printing the other side of printing material 04, in which case printing forme cylinder 07 would then serve as the impression cylinder, in contrast. If printing press 01 is embodied as a web-fed printing press.

Although other sizes may also be provided, in this case the impression cylinder, printing forme cylinder and ink collecting cylinder 08; 07; 09, which roll off against one another in the thrown-on position, are each embodied as triple-sized (3:3:3) in relation to the number of printing lengths or copies that can be printed with one revolution. In some variants, they can all be double-sized or quadruple-sized, or can be embodied with different sizes, e.g. in the above sequence 2:2:4 or 2:3:3 or 3:3:4 or 3:4:4.

In the embodiment shown here, during operation, printing forme cylinder 07 carries a number of printing forms embodied as detachable printing plates, corresponding to the number of copies, one in front of the other on its outer circumference. Each printing forme carries on its outer surface the print template, e.g. the engraving, of a print image.

Ink collecting cylinder 09, which during printing operation inks up printing forme cylinder 07 with multiple colors, has a surface which is elastically and/or compressibly deformable, e.g. a surface comprising rubber. The printing sections or copies can be provided on a circumferential surface that is continuous in the circumferential direction, e.g. a sleeve-like rubber blanket, on a single finite rubber blanket that extends around nearly the entire circumference, or on a plurality of, e.g. preferably on one printing blanket per copy, as indicated, e.g. in FIG. 1, thus in this case three printing blankets.

Upstream, the ink collecting cylinder 09, in the thrown-on or engaged position, cooperates for its inking up with multiple colors with a plurality of cylinders 11, preferably embodied as selective inking cylinders 11, also referred to as stencil cylinders 11, which cooperate for their inking up with a plurality of inking units 12, e.g. with a number of inking units 12 that corresponds to the number of cylinders 11, for their inking up with a single color or optionally with two colors (rainbow printing). Stencil cylinders 11 are provided on their surface with stencils, e.g. in the manner of a letterpress forme having a relief of a contour, corresponding to the relevant color or color combination, for the color pattern of the sections of the print image that relate to this color or color combination. These are preferably embodied in the above sense as having only a single-sized circumference.

In principle, inking units 12 of any design can be assigned to the stencil cylinders 11 for the inking thereof, as long as said inking units each comprise at least one ink feed device 17 described in the following, which is zonally adjustable with respect to ink application, e.g. an ink fountain 17 that cooperates with an inking unit roller 18. Ink fountain 17 and the cooperating inking unit roller 18 can be regarded together as ink feed and metering device 19, by which the volume of printing ink to be applied in inking unit 12 and/or the printing unit can be zonally adjusted. In principle, any single-train or multiple-train cylinder system can be provided for ink transfer between ink fountain 17 and stencil cylinder 11. Although the ink feed and metering device 19 is presented here in connection with a printing unit of a printing device 02 advantageously embodied as a gravure printing unit 02, the embodiment can be applied to inking units 12 of any configuration and to printing units or printing devices 02.

In the embodiment preferred here, however, inking units 12 are embodied as so-called short inking units 12, and stencil cylinders 11 are inked up upstream in the thrown-on position by one, or preferably in parallel by a plurality of inking unit rollers 21, in particular ink forme rollers 21, e.g. two, which in turn receive the ink from the abovementioned inking unit roller 18, e.g. ink fountain roller 18—e.g. without additional interconnected rollers. In addition, at least one oscillatable roller 22, e.g. distribution roller 22, can be provided on the periphery of the ink fountain roller 18.

For its metered inking up, ink fountain roller 18 cooperates with ink feed device 17, which is preferably embodied as ink fountain 17, as described in the following.

Ink feed device 17 comprises an integral or multipart frame 23, e.g. ink fountain frame 23, which is and/or can be mounted fixedly or preferably pivotably on a frame 24, e.g. a side frame 24, which supports inking unit rollers 18; 21; 22 via corresponding bearing devices, in a manner not described in greater detail. The preferably pivotably mounted inking unit frame 23 is capable of pivoting, e.g. around a pivot axis A between an operational position, in which ink fountain 17 is disposed in a working position, and a maintenance position, in which ink fountain 17 can be cleaned, for example.

Figure 8:
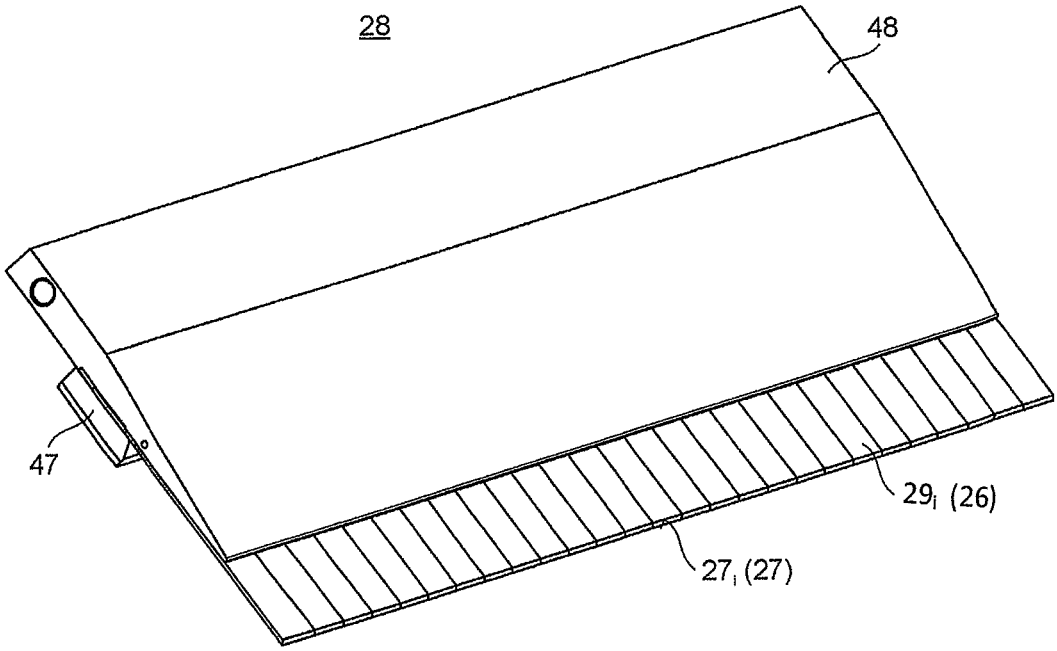
FIG. 8 an enlarged representation of a blade holder holding an integral or multipart ink blade having a sectionally discontinuous metering edge.

In a first embodiment (see FIG. 8, for example), ink blade 26 can be embodied as discontinuous, at least in the region of metering edge 27, wherein in a first alternative, an ink blade 26 which is integral and continuous over the nominal width $b_N$ is formed with tongue-like sections $\mathbf{29}_i$, e.g. blade sections $\mathbf{29}_i$, which are formed, for example, by slits beginning from the metering edge. In a second alternative of the first embodiment, ink blade 26 can be formed from a plurality of individual sections $\mathbf{29}_i$, e.g. blade sections $\mathbf{29}_i$, arranged side by side substantially without gaps.

Figure 7:
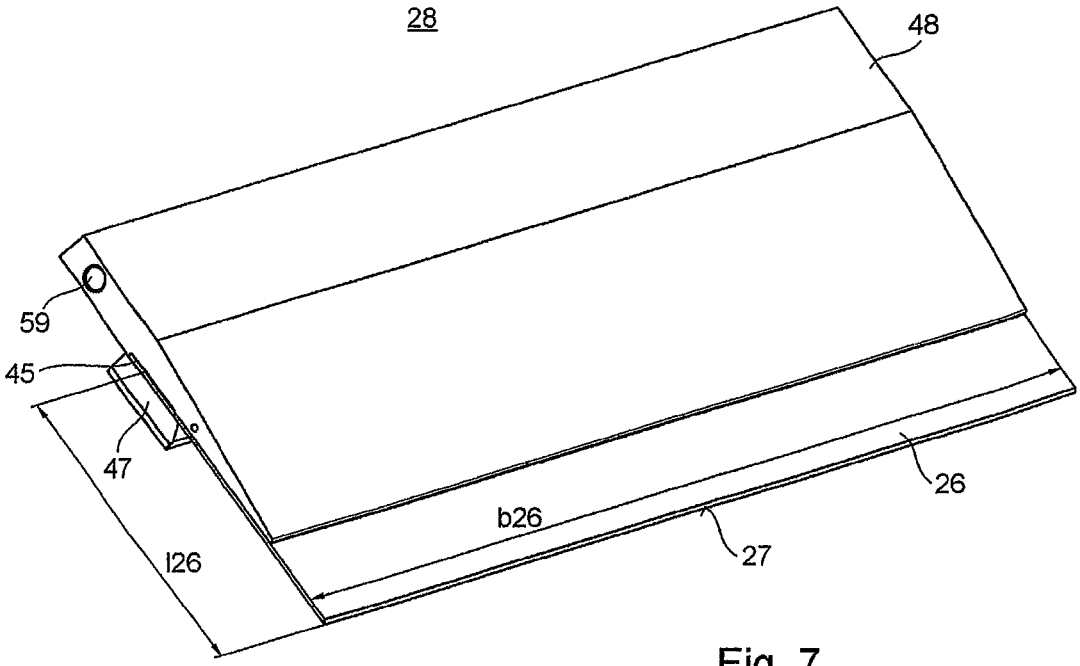
FIG. 7 an enlarged representation of a blade holder holding an integral ink blade having a continuous metering edge.

In a second, preferred embodiment (see, for example, FIG. 7), ink fountain 17 comprises an ink blade 26 which extends over the entire nominal width $b_N$ of ink fountain 17—i.e. over the width of ink fountain 17, on which a metered delivery of ink to a cooperating inking roller 18 is operationally provided,—and which has a continuous metering edge 26 over at least this nominal width $b_N$. This is the edge of ink blade 26 which lies closest to inking roller 18 during operation and which forms a metering gap 42 therewith. In this embodiment, passage through slit-like openings, as can occur in the first embodiment of ink blade 26, is completely excluded. However—in contrast to the discontinuous stepped profile of individual blade sections $\mathbf{29}_i$—the continuous metering edge 27 provides a profile of a zonally adjusted ink profile with softer transitions. The print quality in critical gravure regions can thereby be improved.

The "nominal width" $b_N$ is defined here as the width of ink feed device 17, which is designated by the manufacturer as the usable inking width and/or on which ink can and/or will be applied in a controller manner to inking unit roller 18 operationally, dependent on the structure. The continuous or discontinuous metering edge 27 then has, for example, at least or precisely this nominal width $b_N$, which can then also be understood as the "functional width" of the ink blade. Even if lateral regions—for example for securing, transport or guidance purposes—optionally extend laterally beyond the width of the metering edge, in cases of doubt, the concept of width b26 of ink blade 26 is understood as the functional width thereof, that is to say, the width of functional metering edge 27.

Along the width of ink blade 26, a plurality of adjusting means 31, e.g. adjustment levers 31, are provided, disposed side by side as viewed in the direction of nominal width $b_N$ of ink fountain 17, in order to vary or be capable of varying sections $\mathbf{29}_i$ of the integral or multipart ink blade 26, at least in the region of metering edge 27, in terms of the respective distance $a_i$ occupied by the ink blade in the operational position from the circumference of the inking unit roller 18 to be inked up by ink feed device 17. This distance $a_i$ represents the existing gap measurement $a_i$. In the case of the illustrated embodiment of ink blade 26 having a continuous metering edge 27, sections $\mathbf{29}_i$ to be adjusted do not represent individual sections $\mathbf{29}_i$ or zones $\mathbf{29}_i$ having a specific width, and instead represent sections $\mathbf{29}_i$ or zones defined geometrically in terms of the disposition and embodiment of the adjusting means 31 and assigned to the respective adjusting means 31 in the figurative sense on continuous ink blade 26. For example, they can be identified as imaginary or resulting sections $\mathbf{29}_i$ or zones. These imaginary or resulting sections $\mathbf{29}_i$ can be regarded, for example, as blade sections $\mathbf{29}_i$ that terminate on the edge with the end face end of the nominal width $b_N$ and otherwise each terminate at the half between the centers of the contact points of two adjoining adjusting means 31. Independently of the discontinuous or continuous embodiment, these blade sections $\mathbf{29}_i$ are likewise referred to in the following in the same figurative sense as sections $\mathbf{29}_i$ or zones $\mathbf{29}_i$ assigned to adjusting means 31. The infeed or delivery of ink to the inking unit roller 18 can be adjusted zonally by means of these sections $\mathbf{29}_i$, wherein these "soft" resulting sections $\mathbf{29}_i$ result in softer transitions as compared with the sections $\mathbf{29}_i$ of the first blade embodiment $\mathbf{29}_i$ that are actually separated from one another. In the case of the blade sections $\mathbf{26}_i$, defined by their assignment to the adjusting means 31, of ink blade 26 embodied as having a continuous metering edge 27, an effective gap measurement $a_i$, formed by the geometric mean over the width of the above-defined imaginary section $\mathbf{29}_i$, can be regarded as gap measurement $a_i$, for example. For small gap measurement values, however, a limitation of the adjustment path is preferably provided, so that at no point on the sectional width can the distance drop below a minimum distance of, e.g., 0.02 mm.

Figure 22:
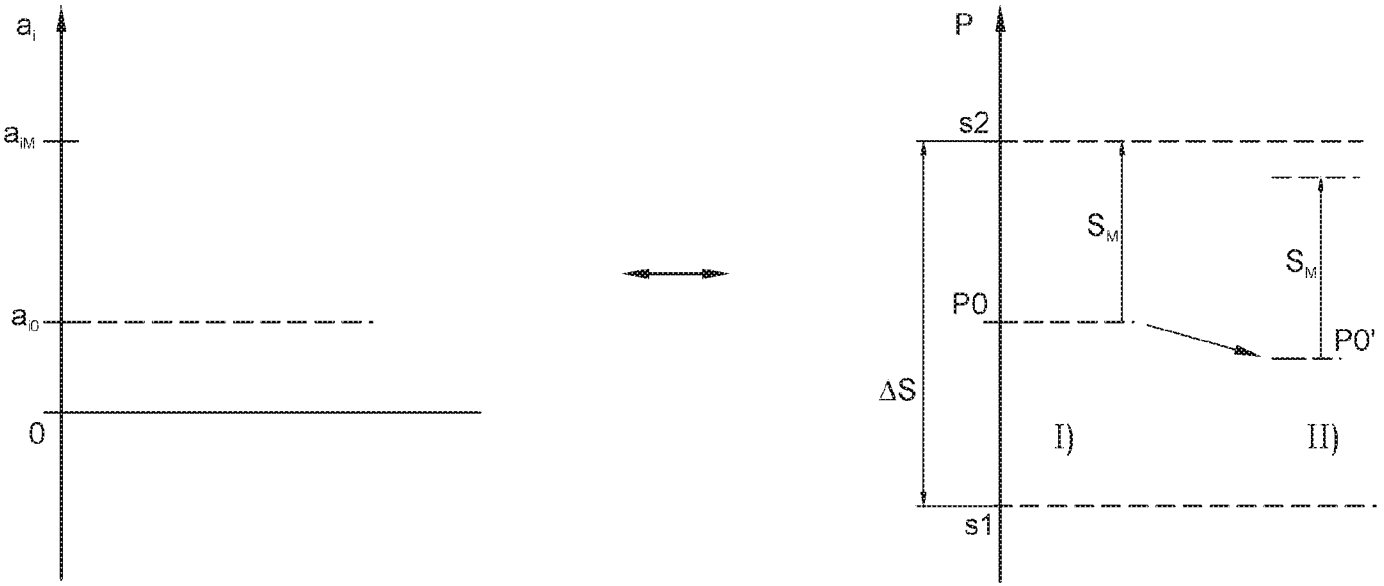
FIG. 22 schematic representations *a*) of a gap measurement of a blade section in various settings and *b*) of corresponding positions of the adjusting means within its adjustment range I) in a basic setting and II) after a readjustment.

Continuous ink blade 26 is made of metal, and preferably as a whole or at least in the region of metering edge 27 is made of a steel having a hardness of at least 55, preferably of at least 60 HRC. At least in the region of its end that comprises metering edge 27, for example, it has no additional coating and/or is homogeneously made of a single material. It can thus be resharpened in the end regions without its functionality and/or characteristics being changed. It has a material thickness of 0.5 to 4 mm, in particular of 1 to 3 mm—over its entire width and length, or at least in the region adjacent to metering edge 27 that cooperates with adjusting means 31, and optionally in the edge region that lies at the opposite end. This can be dependent upon the bending elasticity and/or the hardness of the material that is used and/or upon the dimensions of the section width or zone width that results from the number and distribution of adjusting means 31, and/or upon the free length of ink blades 26, i.e. the length thereof that is not prevented from deforming by clamping or some other type of fastening, in the longitudinal direction thereof extending transversely to metering edge 27 or nominal width $b_N$. The thickness of ink blade 26 is configured in conjunction with the fastening thereof e.g. such that adjustments can be made by an adjusting means 31 up to the adjacent adjusting means, over 50% of the available and/or allowable adjustment range for the adjusting means, i.e. the adjustment range $\Delta S$ for the adjusting means which is electronically limited by the mechanism and/or the control system (see e.g. FIG. 22), which can be 0.20 to 0.50 mm, for example, preferably 0.25 to 0.35 mm, and the deformation of the ink blade can still easily follow this adjustment, i.e. physical contact still exists on the adjacent adjusting means 31, at least at points, between adjusting means 31 and ink blade 26. From one adjusting means 31 to the one after the next, an adjustment of 100% of adjustment range $\Delta S$ can be carried out, without the one of the three adjusting means 31 that is spaced the farthest from ink blade 26, for example, losing any contact with the adjusting means. The center adjusting element 31 is herewith adjusted without contact or approximately at the level of the resulting bending line.

In principle, adjusting means 31 can be embodied as adjusting means 31 to be actuated purely manually, e.g. via levers and/or adjusting screws, or preferably as adjusting means 31 to be actuated by remotely actuable adjustment drives 32, and optionally likewise via transmission parts such as, e.g. levers and/or adjusting screws. The drive, which is indicated merely schematically, can preferably comprise an adjustment drive 32 embodied as an electric motor.

Figure 10:
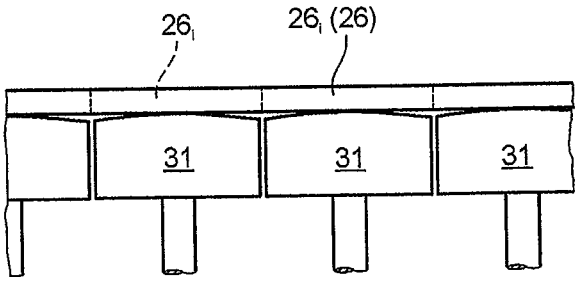
FIG. 10 a front-side sectional view of a segment of an integral or multipart ink blade with interacting adjusting means.
Figure 11:
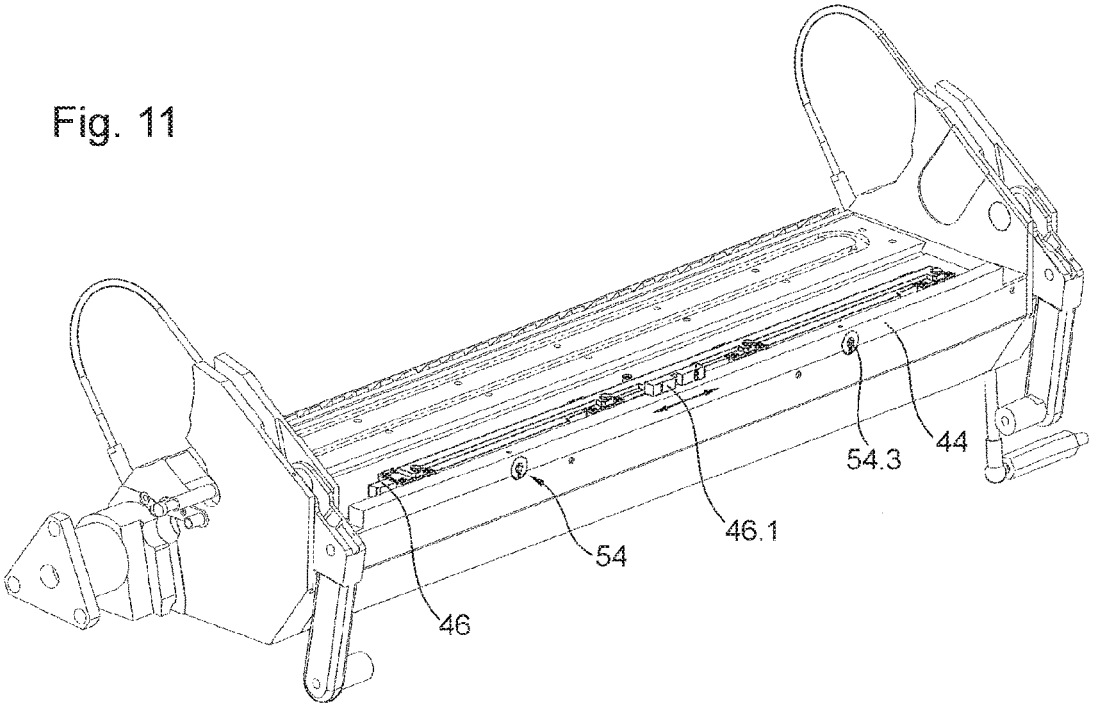
FIG. 11 an oblique view of the ink fountain frame from the rear, without blade holder.
Figure 12:
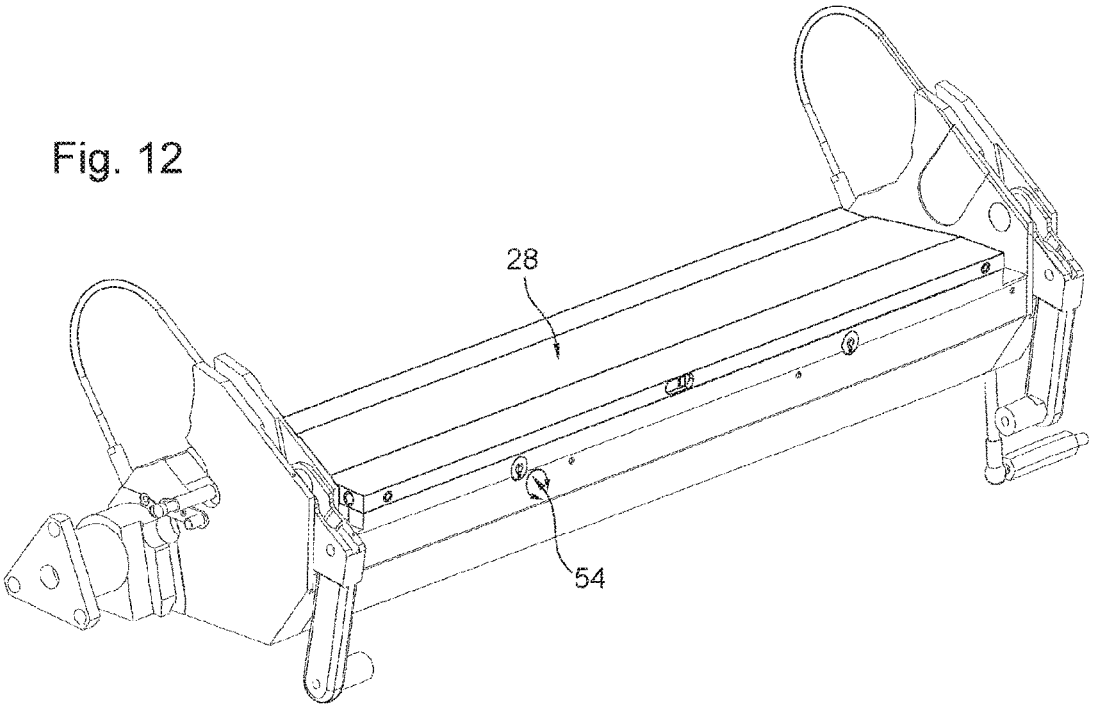
FIG. 12 an oblique view of the ink fountain frame from the rear, with the blade holder inserted.

In principle, adjusting means 31 can have any shape at its end that cooperates with ink blade 26 or with the relevant section $\mathbf{29}_i$. Preferred, however, is an embodiment in which adjusting means 31 comprises a surface that faces section $\mathbf{29}_i$ and is located closest thereto, with the profile of said surface that extends parallel to metering edge 27 varying over a width which corresponds to at least one-third, advantageously at least one-half, preferably at least two-thirds of the width of section $\mathbf{29}_i$, by at most 0.30 mm, preferably at most 0.20 mm in its distance from $\mathbf{29}_i$ or from the highest point. Over this width, a convex profile is preferably provided, which slopes downward in the edge regions from the highest point closest to section $\mathbf{29}_i$ or touching said section first. In an advantageous embodiment, a convex profile of this type extends over a width which corresponds entirely, with the exception of gap-like intermediate spaces that are required for mobility, i.e. at least 99%, to the section width, and which slopes downward in the edge regions by at least 0.10 mm and by at most 0.30 mm from the highest point closest to section $29_i$ or touching said section first (see, e.g. FIG. 10).

Regardless of whether ink blade 26 is in the integral or the multipart embodiment, here its extension in the direction of nominal width $b_N$, i.e. in a direction parallel to the continuous or discontinuous metering edge 27, is referred to as width b26 of ink blade 26, and its extension perpendicular thereto is referred to as its length I26.

In the mounted state, the integral or multipart ink blade 26 is held by a blade holder 28 and is detachably connected thereto. The connection between ink blade 26 and blade holder 28 can be embodied, in principle, as force-fitting (e.g. by means of clamps) and/or as form-fitting (e.g. by means of a corresponding shaping or retaining means). Preferably, ink blade 26 is clamped between two clamping arms, between which a clamping gap 45 is formed, which is delimited at the rear, for example, by a connecting section or connecting means. Clamping gap 45 or the gap length I45 thereof is understood as the maximum length of the gap into which an ink blade 26 can extend.

In a preferred embodiment, ink blade 26, when mounted on blade holder 28 and ready for operation, i.e. ready for use, is held in blade holder 28 in solely a force-fitting connection to prevent movement in the longitudinal direction of the blade holder, i.e. to prevent movement both further into blade holder 28 and out of the blade holder. At its holder-side end, it is embodied without a positive connection to blade holder 28 to prevent longitudinal movement and/or without contact with a stop to prevent longitudinal movement. Clamping gap 45 is configured e.g. with a greater length I45 than would be necessary for receiving ink blade 26 that has been mounted and is ready for operation.

Although the extension of ink blade 26 along metering edge 27 can be greater than its extension from the end on the holder side to the end on the metering edge side, here the former extension is designated as its extension in the widthwise direction or as its width b26, while the latter extension is designated as its extension in the longitudinal direction or as its length I26. The extension that characterizes the depth of ink blade 26 is also referred to as its thickness.

Figure 5:
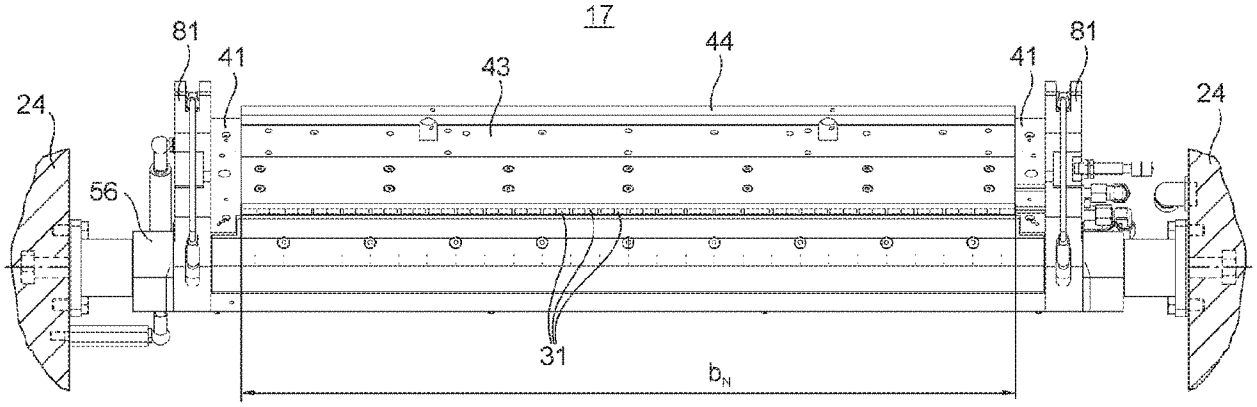
FIG. 5 a front elevation view of the ink fountain frame with blade holder inserted, mounted on the inking unit frame.

Blade holder 28 in turn is or can be detachably arranged on ink fountain frame 23 via a form-fitting and/or force-fitting connection 33. Ink blade 26, which is disposed in or on installed blade holder 28, optionally plus a portion of the top side of the blade holder, together with end-face side walls 41 (see, e.g. FIG. 5) and a circumferential section of inking unit roller 18 to be inked up, delimit, for example, an ink reservoir space for the printing ink to be metered into inking unit 12.

Once connection 33 has been released, blade holder 28, together with ink blade 26 held thereon, can be separated as a complete unit, i.e. without prior disassembly of ink blade 26, from frame 23, and is embodied such that it can be repositioned on said frame and reconnected thereto, optionally with ink blade 26 installed, which may advantageously be the same ink blade 26, for example, after cleaning and/or turning and/or sharpening, or optionally a new ink blade 26.

Figure 6:
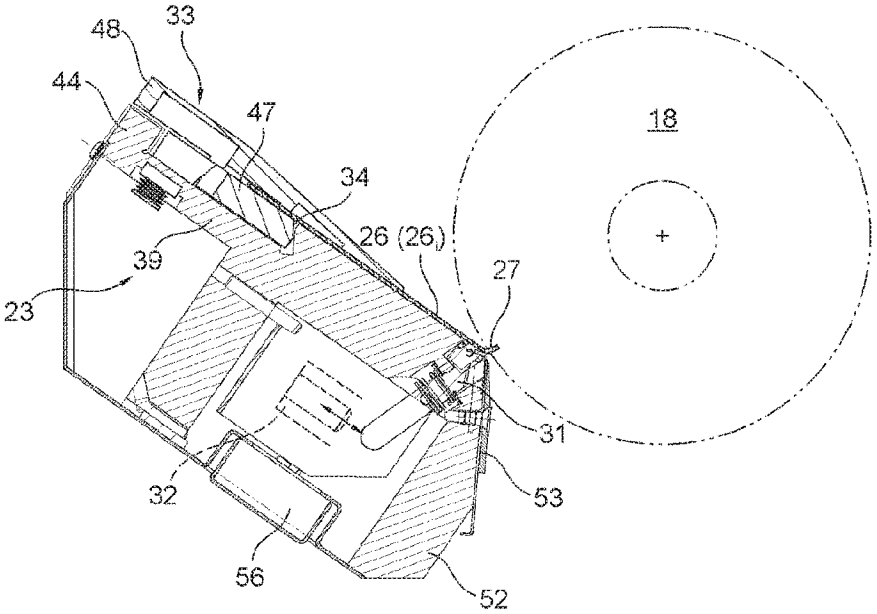
FIG. 6 a schematic sectional view of the ink fountain in the operational position, thrown onto an inking unit roller.
Figure 9:
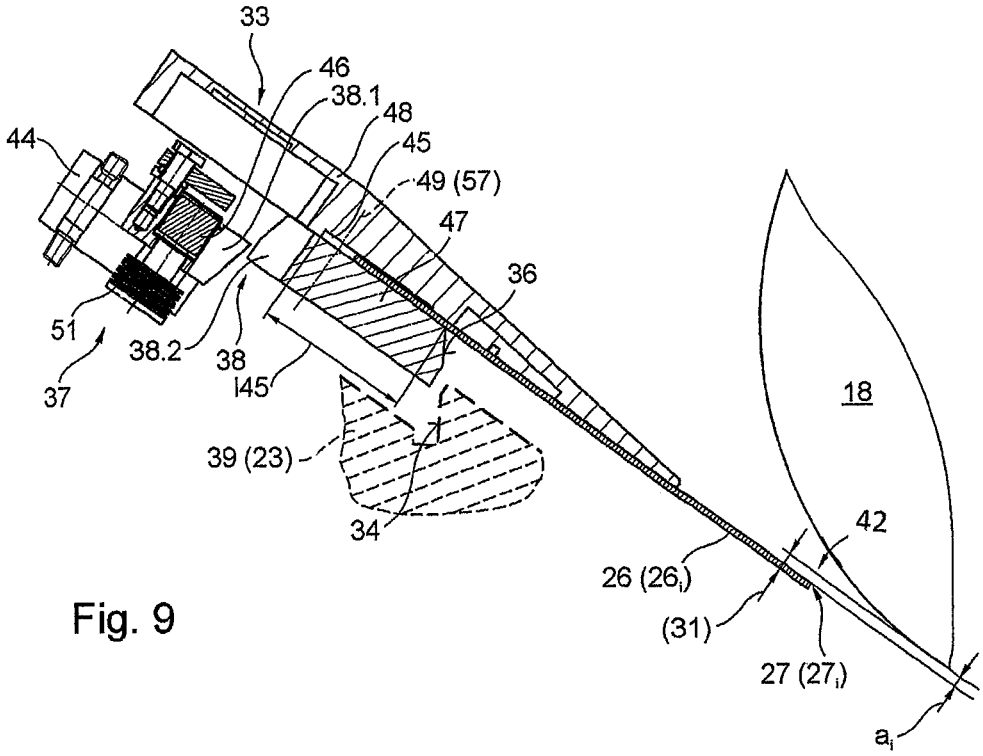
FIG. 9 a schematic sectional view of a blade holder holding an ink blade and having an interacting inking unit roller.

To be able to use blade holder 28 that carries ink blade 26—regardless of whether this is the same ink blade that has been machined or turned or a new ink blade—in a reproducible manner relative to the frame and/or to inking roller 18, a stop device that limits the movement of blade holder 28 toward metering edge 27 and has a stop 34, e.g. holder stop 34, that is fixed to the frame is provided, which cooperates with a stop surface 36 that is fixed to the blade holder (as indicated in FIG. 9 with FIG. 6, for example).

In principle, the detachable connection 33 between blade holder 28 and ink fountain frame 23 can be implemented in any way, for example by means of a screw connection or some other type of positive connection.

Preferably, however, a fastening device 37 is provided, by means of which blade holder 28 can be moved relative to stop 34, which is fixed to the frame and is preferably disposed on the front side in relation to blade holder 28, and/or can be fixed thereto. Advantageously, a connection 33 of this type comprises a fastening device 37 in the form of a—preferably spring biased—clamping device 37, by which blade holder 28 is attached securely to the adjusted stop 34. In the case of the spring biased embodiment, the clamping device is preferably biased in the direction of the active clamping action. In principle, the spring bias can be effected by a spring element of any configuration, but in the embodiment described is configured as a compression spring.

In a preferred embodiment of the detachable connection 33, fastening device 37 comprises a mechanism 38, in particular a—preferably spring biased—wedge drive 38, by which blade holder 28 can be forced against stop 34, which is fixed to the frame and is disposed on the front side, and at the same time against at least one additional frame section 39, which supports blade holder 28 in a defined manner, e.g. on the top or the bottom side, in such a way that in the operating state, the blade holder occupies a position which is defined in terms of frame 23 and/or can be reproduced as desired. Stop 34 and the support surface of frame section 39 are arranged such that, when connection 33 is closed, e.g. when a load is applied to wedge drive 38, movement of blade holder 28 in any direction extending perpendicular to the alignment of metering edge 27 is suppressed. Wedge drive 38 can be supported on the frame side, for example by means of a first wedge 38.1, which is assigned to frame 23, against a counter bearing 44 fixed to the frame, to prevent movement in a direction away from metering edge 27. In this context, the expression 'assigned to the frame' means that the first wedge 38.1 is assigned structurally to frame 23, i.e. is arranged thereon, even if it can be or is mounted movably thereon for the purpose of executing the adjusting or clamping movement. As is clear, for example, from FIG. 9, this first wedge 38.1 cooperates as a first clamping element 38.1 on the side of its preferably wedge-shaped functional surface with a preferably wedge-type functional surface of a second wedge 38.2 as a second clamping element 38.2, as a clamping device embodied as a wedge drive 38. In principle, second clamping element 38.2 can likewise be assigned to frame 23, but can particularly be mounted so as to be movable with at least one component in the direction of the metering gap, wherein second clamping element 38.2 presses against blade holder 28. However, it may alternatively be provided on blade holder 38.2, in which case it is embodied as part of blade holder 28 or as an attachment thereto. At least one, and preferably both cooperating functional surfaces of clamping elements 38.1; 39.2 can be embodied as wedge-shaped.

In an advantageous embodiment, blade holder 28 is embodied in the form of an insert, which can be inserted with at least a lower part into a corresponding recess 43 in an otherwise, e.g. substantially closed upper side of the integral or multipart frame 23. In the direction of metering edge 27, for example, stop 34 forms the boundary of the recess, and in the opposite direction it forms the counter bearing 44 which supports e.g. wedge drive 38. The latter can form an optionally detachable frame section as a correspondingly shaped part of the adjoining frame section or in the manner of a rear strip 44. Frame section 39, which forms and/or at least comprises the support surface, is herewith provided in the recess 43, which is delimited on the front and rear sides by stop 34 and counter bearing 44.

To avoid an unnecessarily long adjustment path for the fastening device 37 embodied e.g. as clamping device 37, in particular for mechanism 38 embodied e.g. as a wedge drive 38, to enable removal and loading, and/or in order to increase the security against blade holder 28 becoming unintentionally separated from frame 23, fastening device 37 can comprise a transverse locking mechanism—e.g. in the manner of a bayonet closure, which, before removal and/or optionally based on the last position occupied by the transverse locking mechanism, requires a transverse movement before insertion of blade holder 28, i.e. a movement of transverse locking mechanism 46 substantially parallel to metering edge 27. In an advantageous embodiment of the transverse locking mechanism, which is combined with the embodiment of mechanism 38 as a wedge drive 38, wedge 38.1 or wedges 38.1 of wedge drive 38 that are assigned to frame 23 is/are connected to transverse lock 46 and is/are optionally placed by this, by virtue of the transverse movement, in engagement with the wedge 38.2 or wedges 38.2 that is/are fixed to the blade holder, or is/are moved out of engagement therewith. To displace the transverse lock 46, embodied, for example, as bar 46, a corresponding meshing or engaging means 46.1 that is accessible to press operators can be provided.

Independently, in principle, of the displaceability of bar 46 in the transverse direction, but preferably connected therewith, this bar can be advantageous, in principle, for the embodiment comprising a plurality of wedge drives 38 or wedge pairs 38.1; 38.2, for the simultaneous operation of wedge drives 38 by moving bar 46 in a direction having a component that is perpendicular to the transverse direction.

For releasing and closing the wedge connection that is formed via wedge drive 38, a drive 54 that alternatively raises and lowers the wedge that is fixed to the frame and/or is directly or indirectly connected to bar 46 can be provided, for example. In principle, said drive can have any embodiment, for example as a screw drive, but preferably as an eccentric drive 54. Driving is implemented by rotating an integral or multipart shaft 54.1, which is pivotably mounted in frame section 39, for example, particularly in the part of frame section 39 that forms counter bearing 44, which comprises an eccentricity 54.2 that cooperates directly or indirectly with one or more wedge drives 38, in particular with bar 46 that is assigned to the plurality of wedge drives 38. This eccentricity 54.2 can be formed by the shaping of shaft 54.1 itself or by an eccentric disk 54.2 connected thereto. The integral or multipart shaft 54.1 comprises an engaging means 54.3, for example, in a region that can be accessed from outside of frame section 39, which is capable of pivoting, for example in the form of a handle, directly or by means of a tool, e.g. an Allen screw that engages in a corresponding carrier profile.

Independently, in principle, of the embodiment details regarding fastening device 37 and/or drive 54, but preferably in connection with fastening device 37 which comprises a wedge connection and/or in connection with the drive 54 which is embodied as eccentric drive 54, a first clamping element 38.1 is therefore provided on frame 23, and is disposed movably on frame 23 and can be moved by a drive mechanism 54 such that, for closing fastening device 37, the movement of first clamping element 38.1 causes a movement of a second clamping element 38.2 and/or of inserted blade holder 28 with at least one movement component in the direction of metering edge 27, wherein, e.g. second clamping element 38.2 can be merely a part of or an attachment on blade holder 28, or can likewise be movably disposed on frame 23 and, when blade holder 28 is inserted, can be disposed so as to cooperate therewith. Conversely, for detaching or clamping fastening device 37, first clamping element 38.1 can be moved away from metering edge 27 by means of drive mechanism 54 with at least one movement component, thereby releasing the clamping connection between first clamping element 38.1 and second clamping element 38.2 and/or the inserted blade holder 28.

Although an embodiment of clamping element 38.1 that is different in terms of its drive for closing and opening the clamping is advantageous, in a simplified embodiment, clamping element 38.1 can also be formed by a part of drive mechanism 54 itself, for example by a threaded component, screw base or screw head of a drive mechanism 54 embodied as a screw drive 54, which cooperates with the blade holder.

Although, as described above, the detachable connection between ink blade 26 and blade holder 28 can have any embodiment, in principle, it is preferably embodied as a clamp connection 57. In order, for example, to move ink blade 26 at least slightly when the connection is open, i.e. by at least 1 mm, for example, preferably by at least 3 mm, back and forth, for the purpose of adjustment in the longitudinal direction, i.e. along a direction of movement that extends in the direction of metering edge 27, and/or to be able to use an ink blade 26 that has been shortened, for example by sharpening, the connection is preferably embodied such that ink blade 26 and the blade holder 28 that comprises retaining and/or clamping means are embodied as corresponding to one another in such a way that ink blade 28, in particular the end thereof that is opposite metering edge 27, can be positioned continuously within at least a region of two relative positions on blade holder 28 that are spaced significantly, i.e. by, e.g. at least 1 mm, preferably at least 3 mm, in the longitudinal direction and can be clamped in this position. Ink blade 28 can therefore be positioned and fixed continuously in different positions on blade holder 28 in the framework of the above-stated adjustment range, with the end of the ink blade that is opposite metering edge 27, i.e. its rear edge as viewed in the longitudinal direction.

In principle, clamping gap 45 and clamping connection 57 can be formed between two arms of the same clamping element or between clamping arms of two clamping elements 47; 48 of blade holder 28, which, in a self-securing embodiment, for example, can be moved by actuating an actuating means 49 from a narrower clamping position resulting from intrinsic tension to an open position or, as provided here, in the opposite direction from a position that is open in the tension-free state to a clamped position.

For example, a clamping element 47 embodied as a clamping strip 47 is provided, on which ink blade 26 is or can be clamped in a desired relative position, for example, by an elongated opening extending longitudinally along the blade, or by a screw drive, e.g. screw, that engages through a slot provided on the rear edge side (for example using a clamping disk, e.g. washer). In the illustrated and preferred embodiment, ink blade 26 is clamped by the clamping arm of a clamping element 48 embodied as a cover strip 48, in that this clamping arm is tightened, for example, by a screw drive 49, e.g. screw 49, in the direction of clamping arm of clamping strip 47. With corresponding shaping, the two clamping arms of clamping and cover strip 47; 48 form clamping gap 45 between them.

In the embodiment of blade holder 28 that comprises a clamping strip and a cover strip 47; 48, clamping strip 47 can be disposed in the aforementioned recess 43 and/or can comprise the wedge on the blade holder side.

By means of a clamping connection 57 embodied as described above and having excess dimensions in terms of the length of the clamping gap 45 in the region of the holder-side end, ink blade 26 can be placed in varying positions in the longitudinal direction on blade holder 28.

Clamping gap 45 is preferably embodied as having excess dimensions in terms of its length, so that when ink blade 26 is mounted and ready for operation, its end surface, i.e. its end opposite metering edge 27, does not abut in clamping gap 45. In particular, it does not abut against a rigid path limiter, fixed to the blade holder, in the manner of a positive connection on at least one side, which would unyieldingly prevent any further movement into the gap, e.g. with a loosened force closure. However, this is not to be understood, for example, as comprising a yielding, e.g. spring-mounted or flexibly embodied rear edge support, which e.g. despite contact when ink blade 26 is mounted and ready for operation, nevertheless does not form a rigid, form-fitting path limitation, and instead, with the positive connection open or loosened, would permit at least a small amount of movement further into clamping gap 45—for example against the flexible force of an optionally provided support.

"Clamping gap" 45 in this case, in an expansion of the embodiment described by way of example having an extension over large portions of width b26 and having a geometry which is actually substantially gap-shaped in cross-section, can also be understood in a broader sense as any variant of an arrangement of one or more pairs of opposing clamping surfaces, between which ink blade 26 is inserted and clamped. In this expanded meaning, the "length" 145 of clamping gap 45 can then be understood as the length over which the holder-side end of ink blade 26 between the clamping surfaces into blade holder 26 in the longitudinal direction of ink blade 26, without its end abutting blade holder 28. If a stop on the back side were to be missing entirely, this length of clamping gap 45 would be quasi unlimited and would therefore be greater in any case than would be necessary for an ink blade 26 that is mounted and ready for operation. However, in the case of a clamping surface pair that is extended widthwise or multiple clamping surface pairs, this length relates to the length at which, with movement in this longitudinal direction, a first stop occurs at any point on the entire width b26 of ink blade 26. Conversely, this represents the length of an undisrupted insertion between the clamping surface pairs.

Ink fountain 17 or frame 23 thereof can comprise a front strip 52 on the side of the ink fountain that faces inking roller 18 to be inked up, which strip can in turn carry, e.g. a seal 53, made of a flexible or compressible material, for example. A cross-member 56 can further be provided, which is mounted in the above-described manner, fixedly or pivotably on side frames 24, and which carries the remaining parts of ink fountain 17 or frame 23.

On blade holder 28, to facilitate handling, at least one carrying handle 58, e.g. two carrying handles 58, can be provided. These can be fixedly positioned or, in a preferred embodiment, can alternatively be moved into correspondingly prepared recesses 59, by an attachment and engagement of retaining elements.

Although the described embodiment of blade holder 28, which can be removed as a complete unit, in any of the aforementioned embodiments already offers significant advantages in terms of handling and maintenance, on its own, and in and of itself can be assigned particular importance, this is especially true in combination with a mounting device 61, as described in the following.

Mounting device 61 is embodied for the precise mounting of an ink blade 26 comprising a metering edge 27, preferably configured in an embodiment as described above, on a blade holder 28, preferably configured in an embodiment as described above. Mounting device 61 comprises a holding section 62 having a holding device, on or in which blade holder 28 or at least a section of a multipart blade holder 28, e.g. an aforementioned clamping strip 47, can be inserted in a defined position with a stop surface 36 on the blade holder side, embodied, e.g. as described above, against a holder stop 63 that is fixed to the frame with respect to mounting device 61 and limits the movement of blade holder 28 in the direction of ink blade 26 to be mounted.

Figure 14:
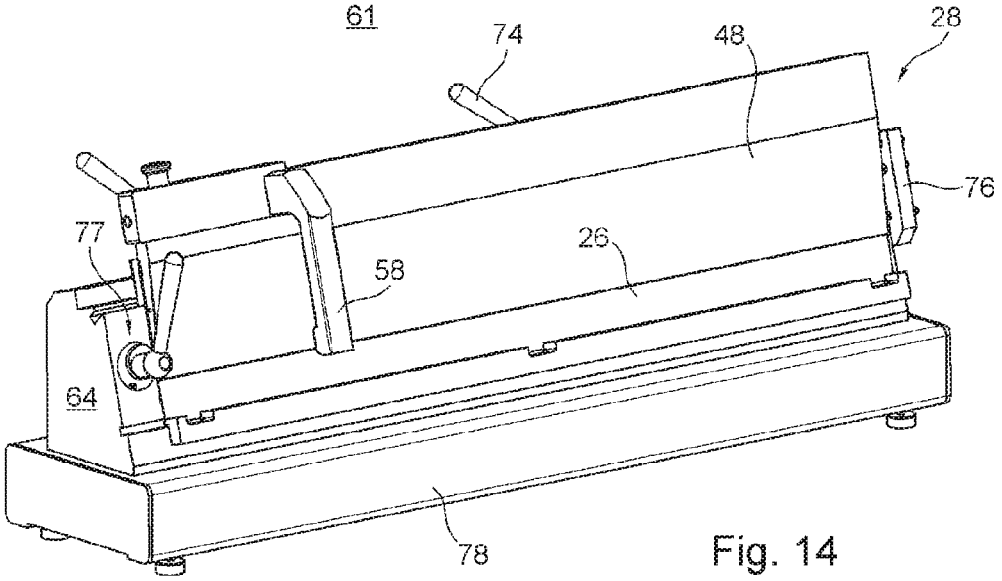
FIG. 14 an oblique view of a mounting device having a continuous ink blade.
Figure 15:
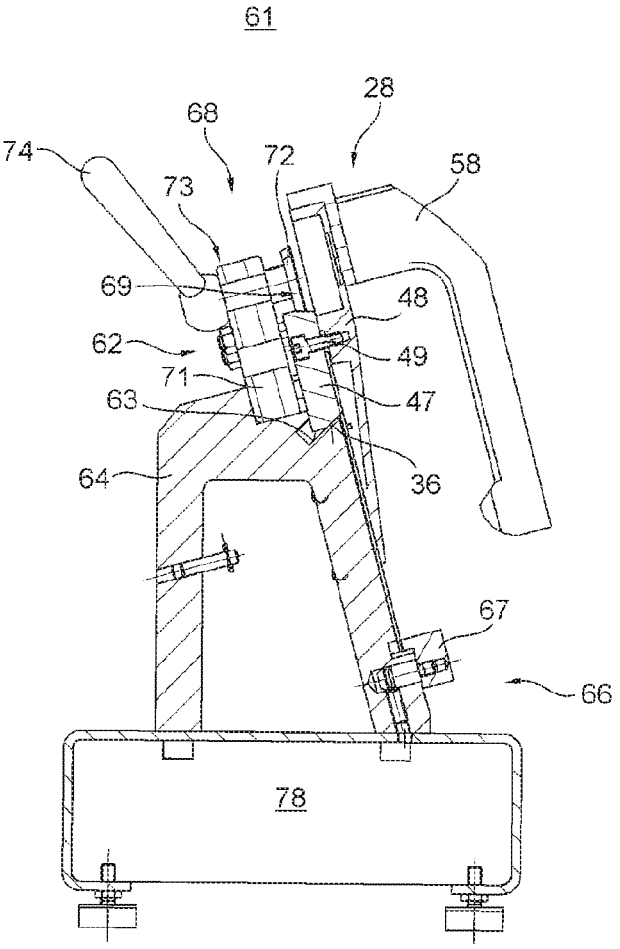
FIG. 15 a sectional view of FIG. 14, but shown without a side stop.
Figure 16:
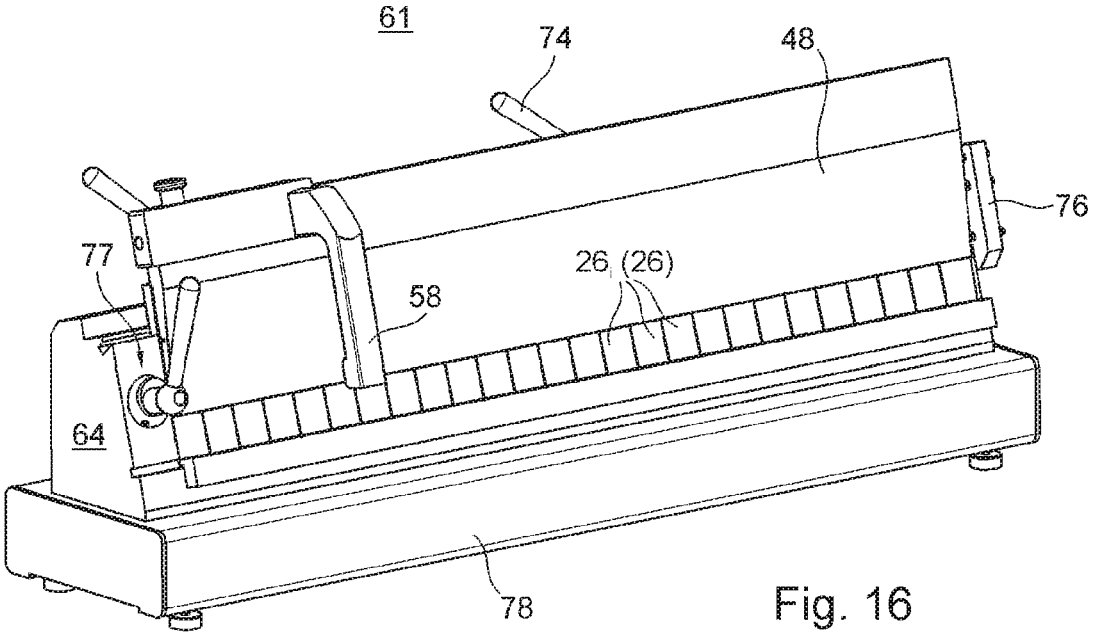
FIG. 16 an oblique view of the mounting device having an integral or multipart ink blade with a sectionally discontinuous metering edge.

Mounting device 61 further comprises a bearing section 66, rigidly connected via an integral or multipart frame 64 of mounting device 61 to the holding device of holding section 62, on or in which bearing section the integral (see, e.g. FIG. 14) or multipart (see, e.g FIG. 16) ink blade 26 to be mounted can be placed with its metering edge 27; V, against a blade stop 67. The configuration and relative position between holding device with holder stop 63 and bearing section 66 with blade stop 67 are determined in the manner of an assembly template such that blade holder 28 inserted into the holding device and ink blade 26 placed on blade stop 67, even in the unconnected state, occupy a position relative to one another, at least in a longitudinal direction of ink blade 26 that extends perpendicular to metering edge 27, which is desired for mounting and is defined by mounting device 61, and which can be reproduced. Blade stop 67 is preferably embodied such that its distance from holder stop 63 can be modified, in particular as at least adjustable, and/or as disposed on frame 64.

Blade holder 28 corresponds to the abovementioned integral or multipart blade holder 28, and/or comprises, in a manner corresponding to the manner described above, retaining means for securing the integral or multipart ink blade 26, particularly in the form of an above-described clamping device 57, which comprises a clamping gap 45, having a clamping strip and a cover strip 47:48, for example.

In this case, ink blade 26 and blade holder 28, which comprises the retaining means, are again embodied, in a manner as described above, as corresponding to one another with an excess dimension in the clamping gap length, such that ink blade 28 can be positioned and clamped continuously within at least a region of two relative positions on blade holder 28 which are spaced significantly in the longitudinal direction, i.e. by at least 3 mm, for example. The statements made above in this regard apply here accordingly. Blade holder 28 is preferably configured as a multipart holder and comprises two strips 47:48, e.g. a clamping strip 47 and a cover strip 48, between which clamping gap 45 is formed—preferably embodied with excess dimensions in the longitudinal direction—, in which the integral or multipart ink blade 26 is clamped in the mounted state.

Here again, ink blade 26 can comprise a plurality of elongated openings or end-side slots spaced from one another in the transverse direction of ink blade 26, each extending in the longitudinal direction of ink blade 26, through each of which, in the clamped state, retaining means, for example a sleeve or a screw 49 extend. Preferably, however, ink blade 26 is merely clamped, and has no slots or elongated openings through which retaining means extend in the mounted state. Retaining means 49, embodied, for example, as screw 49, then preferably engages outside of the holder-side end of ink blade 26 on the two arms of the integral or preferably multipart blade holder 28, thereby clamping ink blade 26 between these in the mounted state.

For the detachable connection between blade holder 28 or a part, for example the cover strip or preferably clamping strip 47, of blade holder 28, which is configured as a multipart holder, and mounting device 61 in the region of its holding section 62, a fastening device 68, preferably a clamping device 68, by which blade holder 28 or the one part, for example the cover strip or preferably the clamping strip 47, of blade holder 28, which is preferably configured as a multipart holder, can be placed against the stop 63, which is fixed to the frame with respect to mounting device 61 and which limits blade holder 28 or the one part thereof in a direction of movement toward blade stop 67, and/or can fixed thereto.

Figure 13:
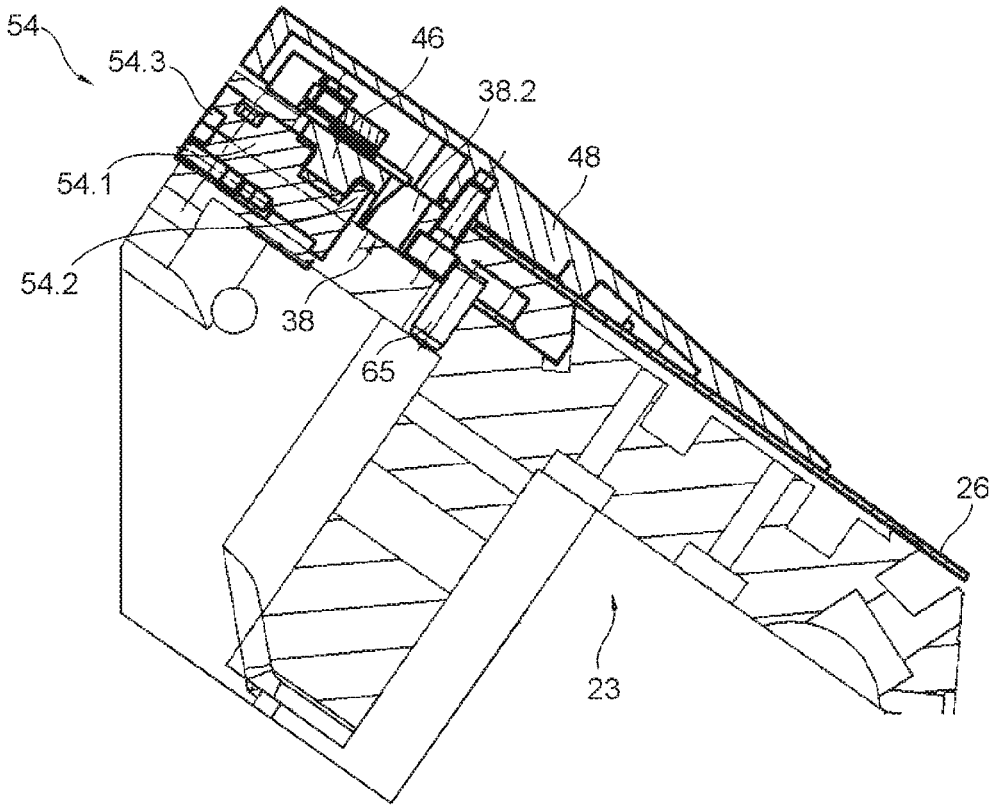
FIG. 13 an enlarged representation of the blade holder inserted into the ink fountain frame along a sectional line that intersects the eccentric drive.

In a preferred embodiment of the detachable connection between blade holder 28 or clamping strip 47 or cover strip 48 and mounting device 61, fastening device 68 comprises a mechanism 69, in particular a wedge drive 69, by which blade holder 28 can be forced against front-side stop 63, which is fixed to the frame, and at the same time at least against an additional frame part 71 that supports blade holder 28, e.g. on the top side or the bottom side in a precise manner, in such a way that, in the fixed state, it occupies a position that is defined with respect to frame 64 and/or can be reproduced as desired. The reproducibility of the position can be increased by a stop device, which prevents or at least severely restricts a relative transverse movement between clamping strip 47 or cover strip 48, for example a positioning pin 65 of one of the strips 47:48 that engages in a corresponding recess in the other strip 47:48. In this case, positioning pin 65 can be provided in cover strip 48 or preferably in clamping strip 47 (e.g. FIG. 13).

Stop 63 and the support surface of frame part 71 are arranged in such a way that, when the connection is closed, e.g. when wedge drive 69 is under a load, any movement of blade holder 28 or the one part thereof, e.g. preferably clamping strip 47, in any direction extending perpendicular to the alignment of metering edge 27 is prevented. Wedge drive 69 comprises, for example, the wedge assigned to blade holder 28, which wedge cooperates with a wedge 72 to be allocated to mounting device 61. Wedge 72 to be allocated to mounting device 61 can be embodied, for example, in the manner of a truncated cone-shaped disk 72, which is axially movable by means of a screw drive 73.

For this purpose, for example, a screw engages in a thread provided in frame 64, in particular in frame section 71, with disk 72 being disposed coaxially on the screw in a rotationally fixed or optionally a rotational manner. To enable its pivoting, the screw is connected, for example, to at least one handle 74. To ensure a correct and reproducible lateral position of ink blade 26, an optionally adjustable side stop 76 can be provided on one side, against which ink blade 26 can be fixed by a drive 77, e.g. clamping drive and/or wedge drive 77, disposed on the opposite side. Frame 64 can be mounted on a fixed support or on a base 78.

First, independently of whether ink blade 26 is in an integral or a multipart configuration, a system for feeding and metering printing ink into an inking unit 12 of a printing press can therefore comprise an ink feed device 19 and a mounting device 61, wherein ink feed device 19 comprises a frame 23, on which a blade holder 28 is detachably arranged, which, in the mounted state, carries an integral or multipart ink blade 26, the forward end of which projects beyond blade holder 28 and forms a continuous or discontinuous metering edge 27, wherein blade holder 28 can be disposed detachably on frame 23 in a precise orientation and position with the help of a stop device. Mounting device 61, as described above, comprises a frame 64, on which blade holder 28 for mounting ink blade 26 can be detachably arranged, wherein blade holder 28 can be detachably positioned on frame 61 in a precise orientation and position relative to a blade stop 67, with the help of a stop device, wherein the configuration and the relative position between the stop device for the mounting device 61 and the blade stop 67 are defined in the manner of an assembly template, so that, even before they are connected, blade holder 28 and ink blade 26 occupy a precise and reproducible position relative to one another, in which they can then be connected to one another. Ink feed device 19 and mounting device 61 of the system can be embodied specifically as described above.

Figure 17:
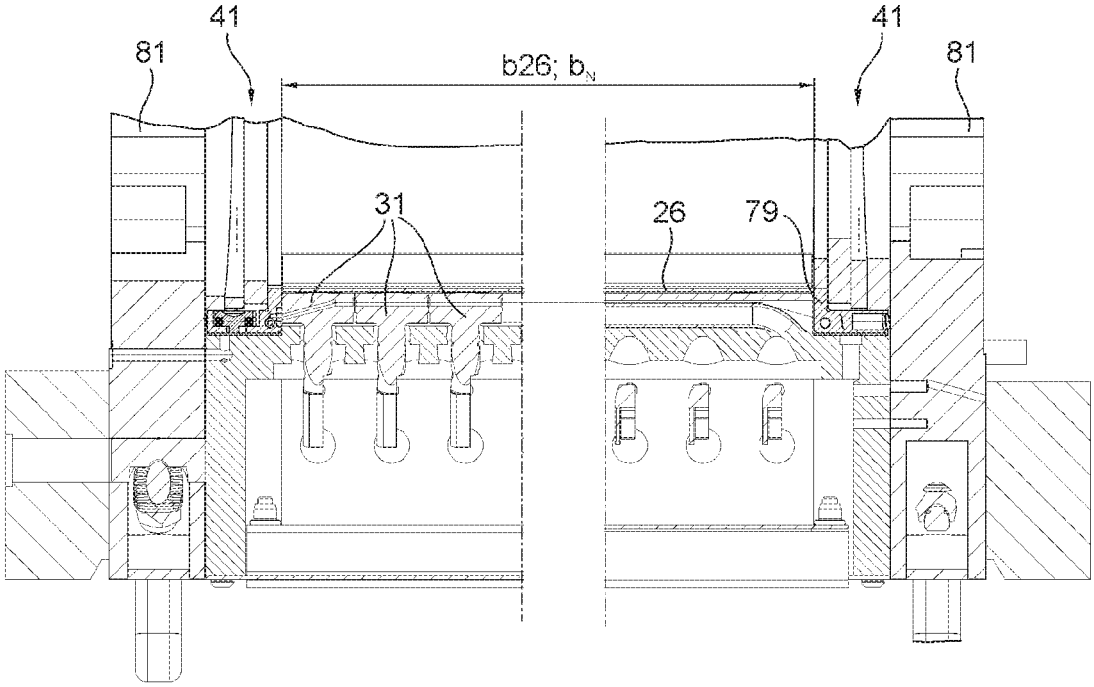
FIG. 17 a front sectional view of a first embodiment of an ink fountain with the side end of the ink blade in the region of the side walls.
Figure 18:
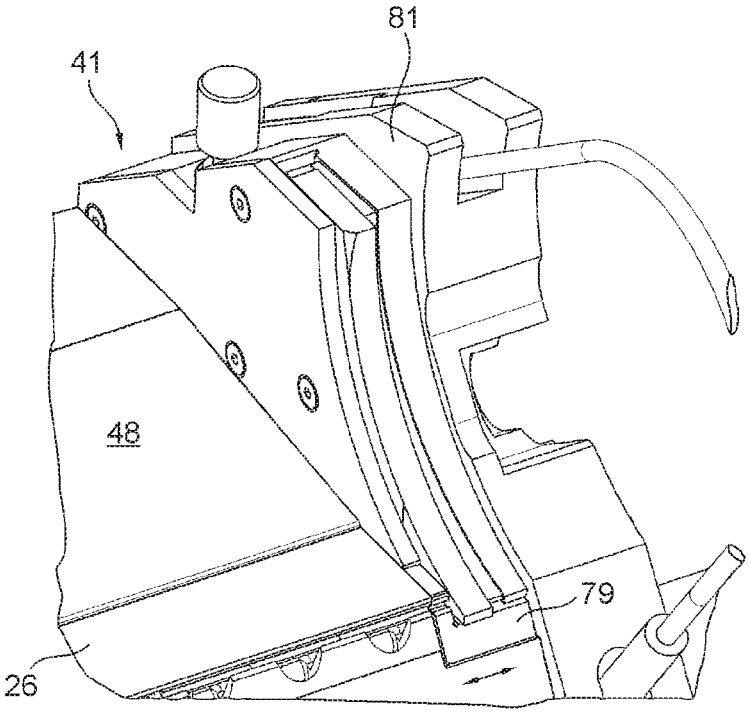
FIG. 18 an oblique view of the side end from FIG. 17.

The integral or multipart ink blade 26, as shown in FIG. 17 and FIG. 18, for example, can have a width b26 that corresponds to nominal width $b_N$, wherein sections $\mathbf{26}_i$ of the continuous or multipart ink blade 26 together make up the zonally adjustable inking unit width. To form a seal toward the side wall, while still allowing ink blade 26 to be inserted, an L-shaped sealing element 79, e.g. an L-rail 79, can be provided on both sides of ink blade 26, with the upper side of said sealing element aligning substantially with the upper side of the adjoining blade section $\mathbf{26}_i$, which is located in the zero position, and which, in the operating position, forms a slight gap with inking unit roller 18 of, e.g., at most 0.08 mm, preferably at most 0.06 mm. Sealing piece 79 is capable of moving at least slightly, e.g.—as indicated, for example, in FIG. 18 by the double arrow—in the direction of nominal width $b_N$ of ink feed device 17, and is capable of moving laterally in the direction of and up to ink blade 26, e.g. by inserting the integral or multipart side wall 41, via a corresponding clamping mechanism. The clamping mechanism, not shown here, is embodied, for example, such that the integral or multipart side wall is supported on its outer side upon insertion into the ink feed device against an outer frame section 81 of frame 23, and is subjected to a force toward the inside in the direction of ink blade 26. When side wall 41 is inserted, ink blade 26 is then sealed laterally toward side wall 41 by means of sealing element 79. In this variant, blade holder 28, which comprises ink blade 26, can be installed and uninstalled without lateral clamping as a result of the transversely movable sealing elements.

Figure 19:
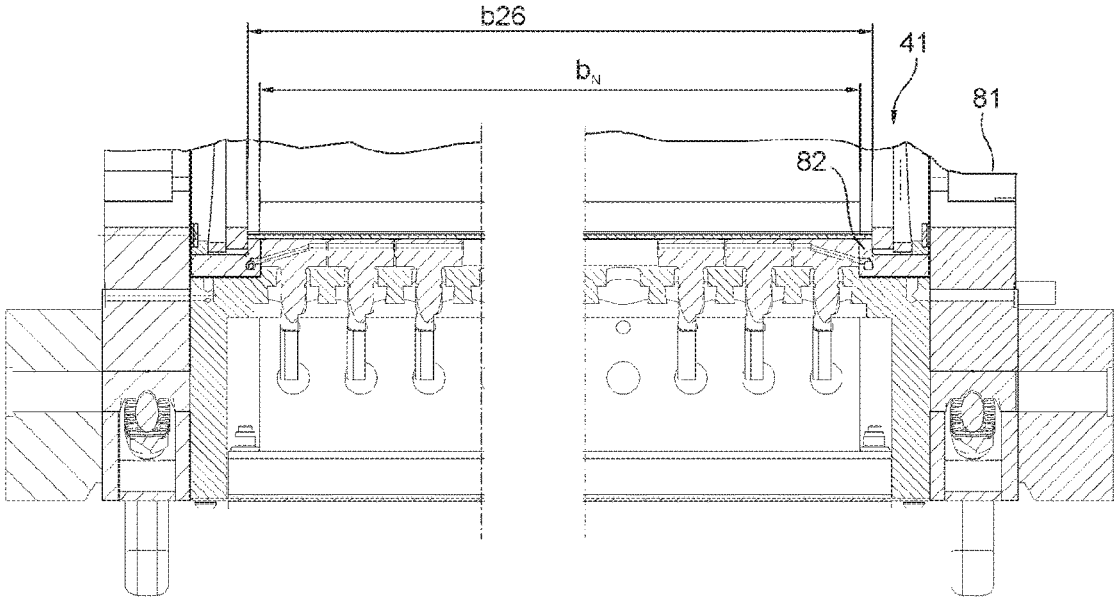
FIG. 19 a front sectional view of a second embodiment of an ink fountain having the side end of the ink blade in the region of the side walls.
Figure 20:
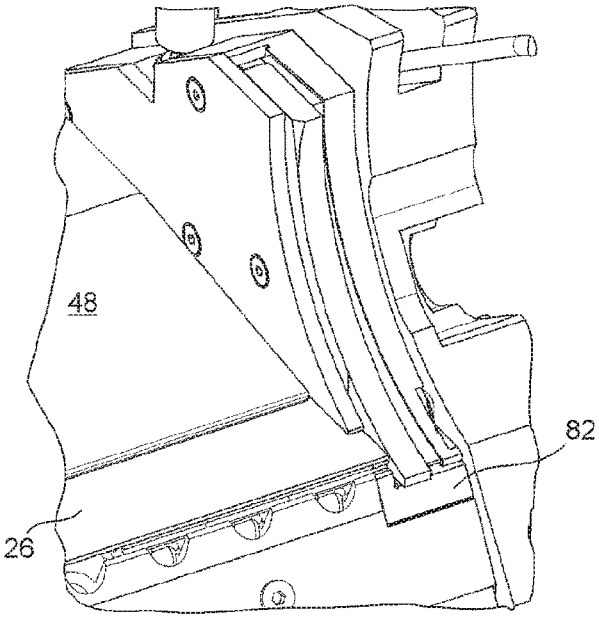
FIG. 20 an oblique view of the side end from FIG. 19.

In an alternative variant, which is advantageous particularly for the case of the continuous, integral ink blade 26, ink blade 26 can be embodied, at least in the region of metering edge 27, as having a width B26 that is greater than nominal width bN, e.g. 2 to 10 mm wider on both sides, and in the installed position, can come to rest in the respective edge region with the overlap on a surface 82 fixed to the frame, e.g. guide strip 82 (see, e.g. FIGS. 19 and 17). In this case, guide strip 82 can be fixedly connected to the outer frame part 81 and/or can be arranged in such a way that, when ink feed device 17 is in the operational position, the part of ink blade 26 that rests on the guide strip forms only a slight gap of e.g. at most 0.08 mm, preferably at most 0.06 mm, with inking unit roller 18. In this variant, blade holder 28 which comprises ink blade 26 can be installed and uninstalled particularly easily without lateral clamping.

Then—independently of a specific one of the above-stated variants—for renewing the metering edge 27 that is used for ink metering, blade holder 28 that carries ink blade 26 is first removed, for example, along with ink blade 26 from ink feed device 19. Metering edge 27, which is used for ink metering, can then be renewed, for example, in that—once blade holder 28 has been removed from ink feed device 17, the ink blade 26, which is still disposed on blade holder 28 or has already been detached therefrom, is resharpened on the end that comprises metering edge 27, thereby forming a metering edge 27' that is renewed by processing in the region of said end. For example, one end can be resharpened up to 10 times, preferably up to 20 times, each time by, e.g. at least 0.5 mm, in particular by 0.5 to 1.5 mm.

Figure 21:
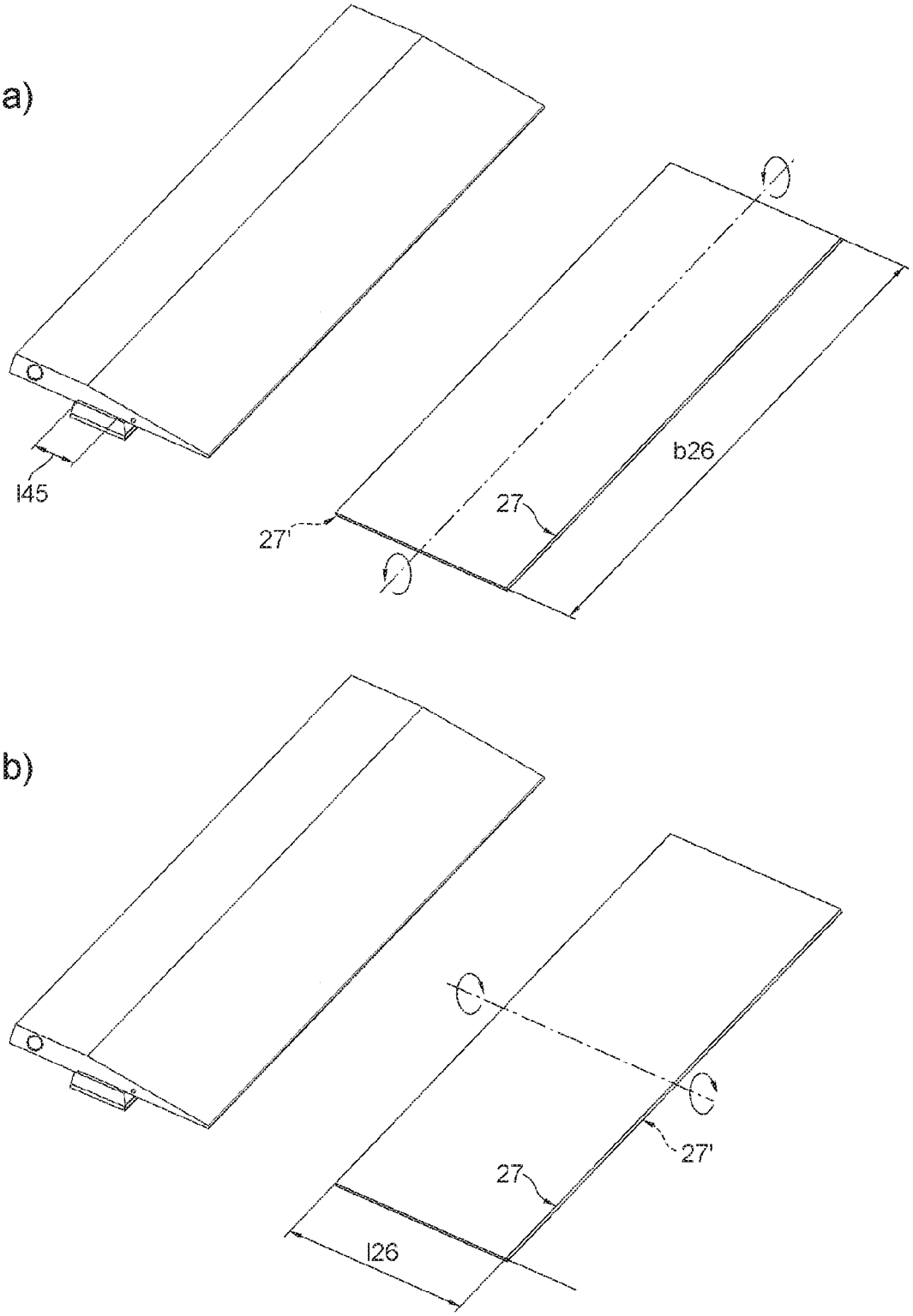
FIG. 21 a schematic representation of the rotation of the ink blade *a*) around its body axis that extends in the direction of its width and *b*) around its body axis that extends in the longitudinal direction.

Alternatively, in a different sequence, renewal can also be accomplished by releasing the force-fitting and/or form-fitting connection between blade holder 28 and ink blade 26, removing ink blade 26 from blade holder 28 and rotating it 180° around a body axis that extends in the direction of width b26 of ink blade 26 (see, e.g. the schematic illustration of FIG. 21*a*) and/or 180° around a body axis that extends in the direction of length l26 of ink blade 26, and then reinserting it, rotated in this manner, and reconnecting it to blade holder 28 (see, e.g. the schematic illustration of FIG. 21*b*). Thus in embodying the integral or multipart ink blade 26 as a flat square having a total of, for example, four edges extending over width b26, four metering edges 27; 27' can be formed by rotating the ink blade.

Rotation and resharpening can also be combined for renewing the metering edge, wherein, e.g. once the options offered by rotation have been exhausted, the metering edge can be resharpened at one or both ends. Metering edge 27 can then be renewed again by rotation.

Before blade holder 28 is inserted, the relative position between blade holder 28 and ink blade 26 is readjusted with respect to the orientation of the new metering edge 27' with the connection released, and the connection is then established with the relative position adjusted. Finally, blade holder 28 along with ink blade 26 is reinserted in a precise position and orientation into ink feed device 19 and fastened therein.

The relative position between blade holder 28 and ink blade 26 is preferably adjusted with respect to the orientation of the new metering edge 27' with the connection released, by using a mounting device that acts as a mounting template, in particular by using a mounting device 61 as described in greater detail above.

For adjusting ink blade 26, blade holder 28 is secured via a stop device in a precise position and orientation on mounting device 61 and the ink blade 26, not yet connected thereto, is placed on blade stop 67. Following placement, the integral or multipart ink blade 26 and the blade holder 28 are connected to one another in a positive and/or frictional connection.

In a preferred embodiment of the ink feed device 17 described above, adjusting means 31 have a significantly greater, e.g. at least 20% greater, adjustment range ΔS for the adjusting means than would be necessary for adjusting the relevant blade section $\mathbf{26}_i$ by a maximum adjustment path $S_M$ between a zero position and a desired maximum position, i.e. a maximum gap width or distance $a_{iM}$ from the periphery of inking unit roller 18 to be inked up by ink feed device 17.

In this manner, during operation of ink feed device 17, the zero position can be readjusted, for example when the gap width present in the zero position has changed as a result of friction. During operation of ink feed device 17, the integral or multipart ink blade 26 of which can be varied by means of respectively assigned adjusting means 31 for forming the ink gap in gap distance $a_i$, that is to say in its distance $a_i$ occupied in the operating position—in particular the distance $a_i$ from the closest edge that acts as metering edge 27—from the surface of assigned inking unit roller 18, a manual zeroing, for example, of the ink gap is first carried out in the zones assigned to adjusting means 31, to a gap measurement $a_{i0}$ that represents the closed position, wherein the gap width is zeroed such that, in this zero position of blade section $\mathbf{29}_i$, the relevant adjusting means 31 is in a zero position P0, which is spaced significantly from both adjustment region ends s1; s2 of the adjustment region ΔS for the adjusting means, e.g. by at least 20% of the adjustment region for the adjusting means. After one or more production phases, the gap width in the blade sections $\mathbf{29}_i$ is checked, with adjusting means 31 located in the zero position P0. If a deviation caused by wear, for example, of one or more of blade sections $\mathbf{29}_i$ from the gap width $a_{i0}$ that is desired for the zero position is observed, the adjusting means 31 assigned to the relevant blade section $\mathbf{29}_i$ is actuated for the purpose of readjustment in a direction such that the desired gap width $a_{i0}$) that represents the closed position is reinstated. Finally, the position P of adjusting means 31 occupied following readjustment is established as a new zero position P0' of adjusting means 31. The gap width $a_{i0}$ that represents the closed position is preferably greater than 0.00 mm, in order to prevent excessive friction. This gap width $a_{i0}$ is preferably at least 0.02 and at most 0.08 mm, preferably 0.04 to 0.06 mm.

Following a single readjustment or multiple readjustments of one or more ink blade sections ai, metering edge 27 of the integral or multipart ink blade 26 according to one of the above-described variants, which is used for ink metering, can be renewed by rotation and/or resharpening.

While preferred embodiments of an ink feed device comprising an ink blade, in accordance with the present invention, have been set forth fully and completely hereinabove, it will be apparent to one of skill in the art that various changes could be made without departing from the true spirit and scope of the present invention which is accordingly to be limited only by the appended claims.

What is claimed is:

1. An ink feed device for an inking unit of a printing press, comprising a frame;

a blade holder that is or can be arranged on the frame;

an ink blade, which, in a mounted state in the blade holder, extends with its width over at least a nominal width of the ink feed device, and which, in its mounted state, is held in a clamping gap of the blade holder and is releasably connected to the blade holder, which ink blade extends, in a longitudinal direction, from an end on a holder side of the ink blade to an end of the ink blade that is distant from the holder, wherein, at its end distant from the holder, the ink blade comprises a metering edge which extends over at least the nominal width and is one of continuous and discontinuous in sections;

end-face side walls, which laterally delimit an ink reservoir space which, when the ink feed device is in the operating state, is delimited, in a lower region, by the ink blade, which is disposed in the blade holder;

a plurality of adjusting means disposed side by side, as viewed along the width of the ink blade, and usable to vary the ink blade in sections, at least in the region of the metering edge in terms of a distance of the metering edge from the periphery of an inking unit roller to be inked by the ink feed device, wherein the clamping gap is embodied having excess dimensions in its length that limits movement of the ink blade, such that, when the ink blade is mounted in the blade holder and ready for operation, the ink blade does not abut, with its holder side end, which is its end opposite the metering edge, against a rigid path limiter that is fixed to the blade holder in the clamping gap;

a stop device on the frame and that limits movement of the blade holder in a direction toward the metering edge and toward the inking unit roller, the stop device having a stop that is fixed to the frame and that limits the movement of the blade holder in a direction toward the metering edge and toward the inking unit roller, and which stop cooperates with a stop surface that is fixed to the blade holder and against which stop the blade holder can be one of moved and acted on by force to occupy its operating position, and a fastening mechanism that is part of a fastening device, wherein the blade holder can be moved by the fastening mechanism of the fastening device against the stop, which is fixed to the frame and which limits movement of the blade holder in the direction of the metering edge and the inking unit roller, and can be secured to the stop.

2. The ink feed device according to claim 1, characterized in that the blade holder is embodied as a multipart holder and comprises two strips, specifically a clamping strip and a cover strip, between which clamping strip and cover strip a clamping gap is formed, in which clamping gap the ink blade is clamped in the mounted, operationally ready state.

3. The ink feed device according to claim 1, characterized in that a first clamping element is provided on the frame, and is movably disposed on the frame to be movable by a drive mechanism such that, in order to close the fastening device, movement of the first clamping element one of causes a movement of a second clamping element, which is one of supported against the blade holder, and is a part of the blade holder and is an attachment thereto, and causes a movement of the inserted blade holder, that movement having at least one movement component in the direction of the metering edge.

4. The ink feed device according to claim 1, characterized in that the fastening mechanism includes a wedge drive having a wedge that is fixed to the frame, wherein, for releasing and for establishing a wedge connection that is formed by the wedge drive, a drive mechanism for one of lowering and raising the wedge that is fixed to the frame, and lowering or raising the wedge drive, is provided.

5. The ink feed device according to claim 1, characterized in that the blade holder is detachably disposed on, and fastened to the frame, via one of a form-fitting and a force-fitting connection whereby the blade holder can be separated from the frame once the one of the form-fitting and the force-fitting connection has been released, together with the ink blade which is held in the blade holder as a unit, without disassembling the ink blade and the blade holder and without using the adjusting means disposed on the frame.

6. The ink feed device according to claim 1, characterized in that, when the ink blade is mounted on the blade holder and is ready for operation, it is held merely by a force-fitting connection in the blade holder against movement in the longitudinal direction of the blade holder;

the ink blade, which is mounted on the blade holder and is ready for operation, is disposed at its holder-side end without a positive connection to the blade holder that would prevent longitudinal movement, and without contact with a stop that prevents longitudinal movement;

wherein the clamping gap that receives the ink blade is embodied as having a greater length than is necessary for receiving the ink blade which is mounted and ready for operation; and wherein the clamping gap is embodied as having excess dimensions in terms of its length, so that, when the ink blade is mounted and ready for operation, it does not abut, with its holder side end that is opposite the metering edge, in the clamping gap.

7. The ink feed device according to claim 1, characterized in that the fastening device is provided as one of a clamping device and a spring-biased clamping device and the stop is disposed on the front side of the frame in relation to the blade holder.

8. The ink feed device according to claim 1, characterized in that the fastening device comprises a mechanism by which the blade holder can be forced against a front-side stop which is fixed to the frame and against at least an additional frame section that supports the blade holder in a defined manner, whereby, in the operating state, the blade holder occupies a position which is defined with respect to the frame and can be reproduced.

9. The ink feed device according to claim 8, characterized in that the fastening device comprises one of a wedge drive and a spring biased wedge drive as the mechanism.

10. The ink feed device according to claim 8, characterized in that the blade holder can be forced against a frame section that supports the blade holder in a defined manner on one of a top and a bottom side of the frame section.

11. The ink feed device according to claim 1, characterized in that at least one carrying handle is provided on the blade holder.

12. The ink feed device according to claim 1, characterized in that the ink feed device is embodied as an ink fountain with zonal ink infeed adjustment, wherein the ink blade which is disposed one of in and on the blade holder, together with end-face side walls and a circumferential section of the inking unit roller to be inked up, delimit an ink reservoir space.

13. The ink feed device according to claim 1, characterized in that the ink feed device is disposed in a printing press which is embodied as one of a gravure printing press and in a printing unit embodied for gravure printing and in an inking unit that cooperates with a selective inking cylinder of a printing unit for indirect gravure printing.

14. The ink feed device according to claim 1, characterized in that the ink blade, at least in the region of its metering edge, is one of made of a steel having a hardness of at least 55 HRC and is embodied as uncoated and as being homogeneous over its entire thickness.

15. The ink feed device according to claim 13, characterized in that the ink feed device is disposed in one of a printing unit embodied for steel engraving printing and in an inking unit that cooperates with a selective inking cylinder of an Orlof gravure printing unit.

* * * * *